US005549052A

United States Patent [19]

Hoffman

[11] Patent Number: 5,549,052

[45] Date of Patent: Aug. 27, 1996

[54] TABLE WITH MOVABLE TOP SURFACE

[75] Inventor: D. Stephen Hoffman, High Point, N.C.

[73] Assignee: Ultra-Mek Corporation, Denton, N.C.

[21] Appl. No.: 178,667

[22] Filed: Jan. 7, 1994

Related U.S. Application Data

[63] Continuation-in-part of Ser. No. 34,495, Mar. 19, 1993, Pat. No. 5,503,086.

[51] Int. Cl.[6] ..... A47B 11/00

[52] U.S. Cl. ..... 108/139; 108/138

[58] Field of Search ..... 108/139, 141, 108/138, 72, 6, 25; 288/281.1, 280.1, 274, 278

[56] References Cited

U.S. PATENT DOCUMENTS

| | | | |
|---|---|---|---|
| 2,285,576 | 6/1942 | Fox | 108/25 X |
| 2,982,050 | 5/1961 | May | 108/6 X |
| 4,194,452 | 3/1980 | Crowther et al. | 108/138 |
| 5,098,053 | 3/1992 | Cotterill | 108/6 X |
| 5,199,360 | 4/1993 | Koistinen | 108/6 X |
| 5,249,533 | 10/1993 | Moore, II | 108/138 X |
| 5,410,971 | 5/1995 | Golden et al. | 108/6 |

FOREIGN PATENT DOCUMENTS

| | | | |
|---|---|---|---|
| 8810081 | 12/1988 | WIPO | 108/141 |

*Primary Examiner*—Jose V. Chen
*Attorney, Agent, or Firm*—Bell, Seltzer, Park & Gibson, P.A.

[57] ABSTRACT

Disclosed herein is a table comprising a base, a table surface, and a mechanism for controlling the movement of the table surface relative to the base. The table surface is movable between a retracted position, in which the table surface is generally horizontally disposed above and adjacent the base, and an extended position, in which the table surface is generally horizontally disposed above the base and a major portion of the table surface resides forwardly of the base. The mechanism is mounted to a table base and a table surface. The mechanism has a front pivot link, pivotally interconnected to the base at a first pivot, and a rear pivot link, pivotally interconnected to the base at a second pivot link. The mechanism is mounted to the surface at the upper portion of the front pivot link at a third pivot, and at the upper portion of the rear pivot link at a fourth pivot. The mechanism is configured such that it can be mounted inboard of the table base end panels.

35 Claims, 8 Drawing Sheets

TABLE WITH MOVABLE TOP SURFACE

RELATED APPLICATION

This application is a continuation-in-part of U.S. patent application Ser. No. 08/034,495, filed 19 Mar. 1993 for TABLE WITH MOVABLE TOP SURFACE, now U.S. Pat. No. 5,503,086 the disclosure of which is herein incorporated by reference in its entirety.

FIELD OF THE INVENTION

This invention relates generally to tables, such as coffee tables and end tables, which are placed near a seating unit to provide a support surface for the occupants of the seating unit, and more particularly relates to tables which have a table surface which moves from its conventional position atop the base of the table to a position more convenient to the occupants of the seating unit.

BACKGROUND OF THE INVENTION

The great majority of residences today include a seating unit, such as a sofa or chair, near which is placed a table, such as a coffee table or end table. Coffee tables can provide a surface for supporting food and drink and displaying decorative items and reading materials, and can also by themselves improve the appearance of the room. Likewise, end tables can provide a support surface for these items as well as reading lamps, telephones, and the like.

One of the drawbacks of the support surfaces provided by coffee tables and end tables is the inconvenient location of the table surface relative to an occupant of the seating unit. For example, if the occupant rests a plate of food or a drinking glass on the coffee table, he must lean forward from a seated position to retrieve it; this is somewhat awkward, particularly with seating units that employ deep, soft cushions. If the occupant wishes to eat from the plate or drink from the glass, he has two options. First, he can lean over the table while eating or drinking, which is even more awkward than simply leaning over the table to retrieve the plate. Second, the occupant can grasp the plate and carefully balance it as it travels with him to the seated position, after which he must support the plate as he eats. Either of these options is unsatisfactory, as the risk of the occupant spilling food or drink onto the table, the underlying floor (which is often carpeted), or the seating unit itself, is significant.

The situation is no better with an end table; the occupant must twist to retrieve the plate or glass from the end table and either consume in this awkward twisted position or balance the plate or glass as it travels and resides over the seating unit. Often the difficulty is exacerbated by the presence of an armrest on the end of the seating unit that the occupant must negotiate.

Further, the typical coffee table provides no surface between occupants seated on either end of a sofa that can serve as a card or game table. Thus occupants of the seating unit utilizing the table for this purpose must twist awkwardly to reach the table.

The underlying cause of these difficulties is the position of the table surface relative to the seating unit. On coffee tables, the table surface is too low and too far forward for easy access to the occupant of a seating unit. On end tables, the table surface is placed beside rather than directly in front of a seated occupant. However, furniture styles dictate that coffee tables provide table surfaces in these locations.

One attempt to address this problem is disclosed in U.S. Pat. No. 2,766,088 to Jackson et al., in which a coffee table is illustrated which includes a table surface that rises and moves laterally from its base to reside in front of an occupant of an adjacent seating unit. A shortcoming of the Jackson et al. table is demonstrated when the occupant wishes to rise from the seating unit while the table is in its extended position. With the table top extended, the occupant may be pinned behind the table; either the occupant must lower the entire table surface to escape, or the table surface must be sufficiently short that it does not rest directly in front of the occupant in the extended position. A similar table is shown in Crowther et al., U.S. Pat. No. 4,194,452, which discloses a coffee table that has two separate table surfaces that can rise and retract independently. This allows the occupant pinned behind the table top to move the tabletop section directly in front of him without disturbing the tabletop in front of the other occupants. Neither of these references disclose a table that provides a tabletop that extends between occupants seated on opposite ends of a sofa. Further, each of these tabletops is moved to the extended position by a bulky mechanism that is unsuitable for many modern table styles, such as "off-the-floor" tables and tables having a base that is relatively narrow in comparison to the tabletop. For these and other examples, the mechanism would be visually exposed and thus render the table unacceptably unsightly.

In addition, the table top for many tables can be quite heavy. As a result, raising the table top can be difficult, particularly for a weak or feeble operator. Further, due to its weight, during lowering the table top can slip from the grip of the operator and slam violently into the closed position. The table disclosed in Crowther et al. includes a pneumatic cylinder attached to the table top and the lower portion of the table legs to provide resistance to the lowering action and thus prevent slamming of the table top during lowering. However, as above, this configuration is limited to table styles in which the cylinder is not exposed.

A further shortcoming of many coffee tables becomes apparent when a table is placed adjacent a seating unit which includes one or more extendable footrests. Generally, to be reasonably comfortable an extendable footrest must extend between about 18 and 30 inches from the front of the chair. The conventional positioning of a coffee table relative to a seating unit places the table so that the tabletop interferes with an extendable footrest as it extends. As a result, seating units that include a footrest must either be placed sufficiently far from the coffee table so that the footrest can be extended without interference, or the table must be moved away from the seating unit prior to the footrest being extended.

Another deficiency of known embodiments of extendable tables in the eyes of some consumers is their appearance. Typically the table is extended through the use of a front and rear pivot link, each of which comprises a straight member extending between pivots. In such a configuration, both the front and rear pivot links are visible to an observer positioned to view the lateral edges of the table. Many consumers find this configuration unsightly and would prefer that the table have a sleeker appearance. In addition, tables controlled by mechanisms having this configuration create a "pinch-point" between the links which can cause discomfort to an operator of the table should he place his finger between the links during lowering of the table surface.

Thus it is a first object of the present invention to provide a table having a movable table surface which is more visually attractive than those of the prior art.

It is another object of the present invention to provide a table having a movable surface which creates no pinch-points between the links of the mechanism during lowering of the table surface.

It is also an object of the present invention to provide a mechanism suitable for use in such a table.

SUMMARY OF THE INVENTION

These and other objects are satisfied by the present invention, which provides as a first aspect a table comprising a base, a table surface, and a mechanism for controlling the movement of the table surface relative to the base. The table surface is movable between a retracted position, in which the table surface is generally horizontally disposed above and adjacent the base, and an extended position, in which the table surface is generally horizontally disposed above the base and a major portion of the table surface resides forwardly of the base. The mechanism comprises: (a) mounting means attached to the base; (b) a front pivot link comprising lower, central, and upper portions, the central portion having front and rear edges, wherein the lower portion is pivotally interconnected with the base mounting means at a first pivot; (c) a rear pivot link comprising lower, central, and upper portions, the central portion having front and rear edges, wherein the lower portion is pivotally interconnected with the base mounting means at a second pivot; and (d) means for mounting the mechanism to the table surface pivotally interconnected with the front pivot link upper portion at a third pivot and with the rear pivot link upper portion at a fourth pivot. The front and rear pivot links are configured so that one of the pivot link central portions is lateral of the other of the pivot link central portions, and so that in the extended position, the rear edge of the lateral most of the pivot link central portions is rearward of the rear edge of the inwardmost of the pivot link central portions, and the front edge of the lateralmost pivot link central portion is forward of the front edge of the inwardmost of the pivot link central portions. Preferably, the central portion of the front pivot link is offset rearwardly from a line extending between the first and third pivots, and the central portion of the rear pivot link is offset forwardly of a line between the second and fourth pivots.

A second aspect of the present invention is a mechanism suitable for use in such a table.

DETAILED DESCRIPTION OF THE PREFERRED EMBODIMENTS

This invention is directed to tables that have a stationary base and a table surface which moves upwardly and laterally from the base to provide a usable raised table surface for the occupant of a chair or sofa. The table surface is moved between an open position, in which the table surface is horizontally disposed and resides directly above and adjacent the table base, and an open position, in which the table surface maintains its horizontal disposition, raises above the table surface, and translates forwardly relative to the table surface. The height and lateral movement of the table surface are controlled by a four-bar linkage attached to the table base and to the table surface. As used herein, the terms "forward" and "forwardly" refer to the direction defined by a vector extending parallel to the table surface of a table from the table toward an adjacent seating unit. Conversely, the terms "rearward" and "rearwardly" refer to the direction directly opposite the forward direction; i.e., defined by a vector parallel to the table surface extending from the table away from an adjacent seating unit. The term "lateral" and "laterally" refer to the direction defined by a vector originating in the center of the table surface and extending in the plane of the table surface perpendicular to the forward and rearward directions. The terms "inboard," "inward," and "inwardly" refer to the direction directly opposite to the direction defined above as "lateral."

Figure 1:
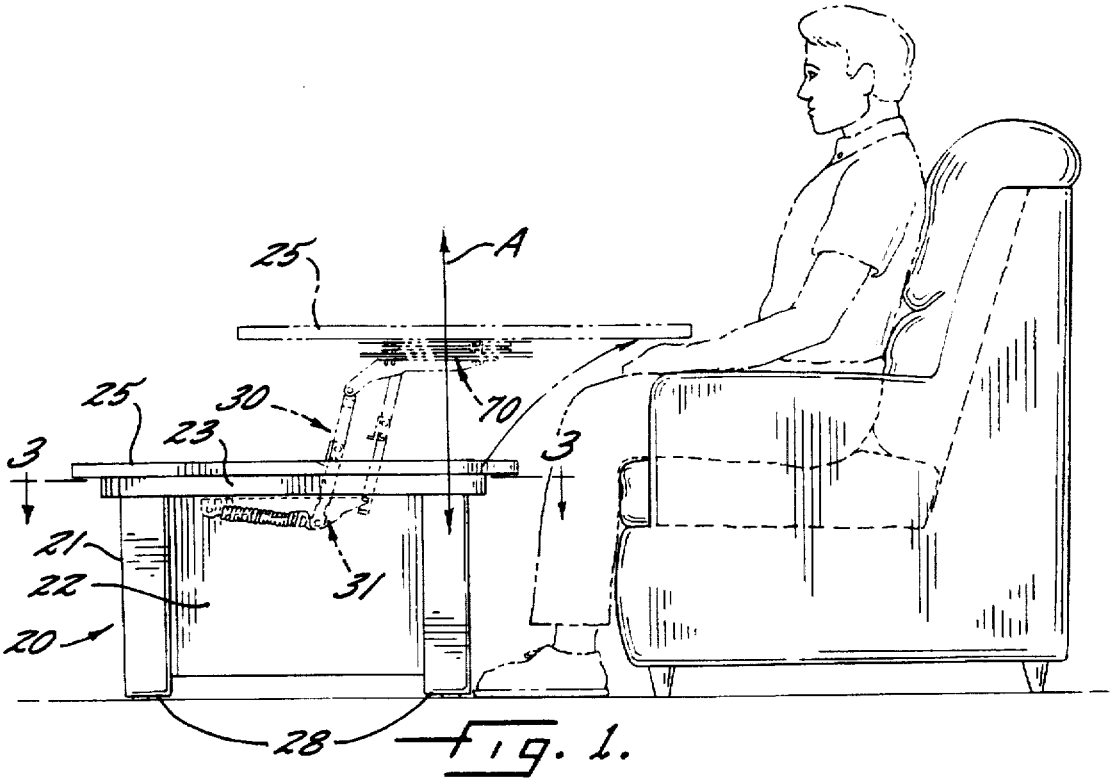
FIG. 1 shows a side elevation view of a coffee table positioned appropriately relative to a sofa and an occupant seated thereon which illustrates both the closed and open positions of the table.

Referring now to the drawings, FIG. 1 shows a coffee table, designated broadly at 20, that includes a stationary base 21 that rests on the floor, a movable table surface 25, a four bar linkage mechanism 30 that controls the movement of the table surface 25 between the open position (shown in solid line in FIG. 1) and the closed position (shown in phantom line in FIG. 1) and a swivel unit 70 that controls the rotational movement of the table surface 25 about an axis of rotation A. Those skilled in this art will appreciate that this invention is not limited to a coffee table as illustrated in FIGS. 1–6 or to an end table as illustrated in FIGS. 7–11, but instead is intended to encompass any table for which dual positions of a rotatable table surface as described above are useful.

The base 21 includes a plurality of support legs 28, a skirt 22, and a mechanism support plate 23. The support legs 28 rest at their lower ends on the floor. The skirt 22 is vertically disposed and is fixed to the upper portions of the support legs 28 so that the outer surface of the skirt forms a visible surface just beneath the rectangular table surface 25. The mechanism support plate 23 (best seen in FIG. 3) is fixed at its perimeter to the upper portions of the support legs 28 and to the inner edges of the skirt 22 so that it is substantially horizontal. The mechanism support plate 23 includes a cavity 24 that includes a central square aperture 29 that is connected at its forward corners to forward slots 27*a*, 27*b* and to its rearward corners to rear slots 26*a*, 26*b*.

The table includes two four bar linkages 30*a*, 30*b* that control the movement of the table surface 25 between the open position and the closed position. As used herein, "four-bar linkage" refers to a series of four structures, or links, each of which is pivotally interconnected to two other links, so that the entire linkage has one degree of freedom of movement. See, e.g., Paul, *Kinematics and Dynamics of Planar Machinery* (Prentice-Hall, Inc., Englewood Cliffs, N.J. 1979). Each four-bar linkage 30*a* comprises a mounting bracket 31, a rear pivot link 40, a front pivot link 50, and a table surface mounting bracket 60. The table has a plane of symmetry P (indicated in FIG. 2) which is normal to the table surface 25 and parallel to and located equidistant from the lateral edges of the table surface 25. The four-bar linkages 30*a*, 30*b* are mirror images of each other across the plane of symmetry P. For brevity and clarity, only one mechanism will be described; those skilled in this art will understand that the description of this linkage applies equally to the mirror image thereof.

The base mounting bracket 31 (FIGS. 4 and 5) includes a horizontal portion 32 and a vertical portion 33. The horizontal portion 32 is a substantially flat plate that includes fastening apertures 34. The mounting bracket is fixed to the underside of the mechanism support plate 23 just lateral of the lateral edge of the cavity 24 by threaded fasteners 35 which are inserted through apertures 34. The vertical portion 33 is fixed substantially perpendicularly to the inwardmost edge of the horizontal portion 32 and extends downwardly therefrom. A rear spring pin 36 is fixed to the rearmost inboard surface of the vertical portion 33. The mounting bracket 31 also includes an aperture 46 for receiving a pivot pin 52, which is positioned at the forwardmost portion of the vertical portion 33, and an aperture 39 for receiving a pivot pin 37 which is positioned rearwardly and slightly downwardly of the aperture 46. Those skilled in this art will appreciate that, although a base mounting bracket is illustrated herein, any means that mounts and pivotally interconnects the rear pivot link 40 and the front pivot link 50 to the base 21 is suitable for use with this invention. Exemplary alternatives include direct pivoted attachment of these limbs to the base, separate mounting brackets for the front and rear pivot links, and the like.

The rear pivot link 40 comprises a body link 41 and a spring extension arm 45. The body link 41 includes an aperture 47 for pivotal interconnection to the base mounting bracket 31 through pivot pin 37, and further includes an aperture 48 for pivotal interconnection to the table surface mounting bracket 60 through a pivot pin 44. Fixed to the central portion of the body link 41 is a rear cross-brace 43 having an L-shaped profile which extends inwardly to a fixed attachment at the same location on the linkage 306 on the opposite side of the table 20. The spring extension arm 45 is fixed substantially perpendicularly to the body link 41 at the aperture 47. A forward spring pin 42 is fixed to the spring extension arm 45 at the end thereof opposite the aperture 37. The forward spring pin 42 extends laterally to receive spring 38, which is attached at its opposite end to the rear spring pin 36.

The front pivot link 50 includes an aperture 54 at one end for pivotal interconnection to the base mounting bracket 31 through pivot pin 52, and also includes an aperture 55 at its opposite end for pivotal interconnection to the table surface mounting bracket 60 through pivot pin 61. At its central portion, the front pivot link 50 is fixed to an upper front cross-brace 51 which extends inwardly to a fixed attachment at the same location on the front pivot link of the linkage 306 on the opposite side of the table 20. At its lowermost portion near the aperture 54, the front pivot link 51 is fixed to a lower cross-brace 53 of hollow square cross-section that also extends to a fixed attachment on the front pivot link of the mechanism on the opposite side of the table.

The table mounting bracket 60 comprises a horizontal portion 63 and a vertical portion 64. The horizontal portion 63 is secured parallel and in contacting adjacent relation to the underside of a swivel unit 70 through threaded fasteners 65, which are inserted through apertures 64. The vertical portion 64 of the table surface mounting bracket 60 is fixed perpendicularly to the lateralmost edge of the horizontal portion 63. The vertical portion 64 includes an aperture 66 at its rearmost portion for pivotal interconnection to the rear pivot link through pivot pin 44, and further includes an aperture 67 positioned upwardly and forwardly of aperture 66 for pivotal interconnection to the front pivot link 50 through the pivot pin 61. Those skilled in this art will appreciate that, although a table surface mounting bracket is illustrated herein, any means that mounts and pivotally interconnects the front pivot link 50 and the rear pivot link 40 with the table surface 25 is suitable for use with this invention. Exemplary alternatives include direct pivotal attachment of these links to a downwardly projecting rib of the table surface, separate mounting brackets for the front and rear point links, and the like. A stop pin 49 is also located on the front portion of the base mounting bracket 31 to halt the forward movement of the mechanism 30*a* in the open position. Those skilled in this art will recognize that any means that can halt the movement of the mechanism 30*a* in the desired position is suitable for use with the invention.

The swivel unit 70 comprises a lower plate 71, an upper plate 74, and a plurality of ball bearings 73. The lower plate 71 is fixed at its lateral portions to the horizontal portions 63 of the mechanisms 30*a*, 30*b* by the insertion of threaded fasteners 65 through apertures 79 into nuts 80. The lower plate 71 includes an upwardly-protruding circular track 72 centered on the lower plate 71. The circular track 72 is substantially semicircular in cross-section and is sized to receive the ball bearings 73. The upper plate 74 is secured at its lateral portions to the underside of the table surface 25 by the insertion of threaded fasteners 78 through apertures 79. The upper plate 74 includes a centrally positioned downwardly-protruding circular track 75 similar in cross-section to circular track 72 which rests atop the ball bearings 73. A threaded fastener 76 extends between the centers of lower plate 71 and upper plate 74 to restrict upward and downward movement of the upper plate 74 relative to the lower plate 71, but to permit rotation of the upper plate 74 (and thereby the table surface 25) relative to the lower plate 71.

The table surface 25 is a substantially planar surface that is disposed substantially horizontally. It induces a visible upper surface 80 that serves as the support surface for items resting on the table. Although a rectangular table surface 25 is illustrated herein, those skilled in this art will understand that the table surface 25 may be of any shape, such as round, square, oval, and the like, and still be suitable for use with the present invention. It is preferred that the table surface 25 be elongated (i.e., having a first length dimension that is greater than a perpendicular second width dimension) such as rectangular, oval, oblong, and the like, so that as it is rotated about the axis of rotation A, the table surface 25 can provide a support surface in different locations relative to the base 21.

Figures 4, 5:
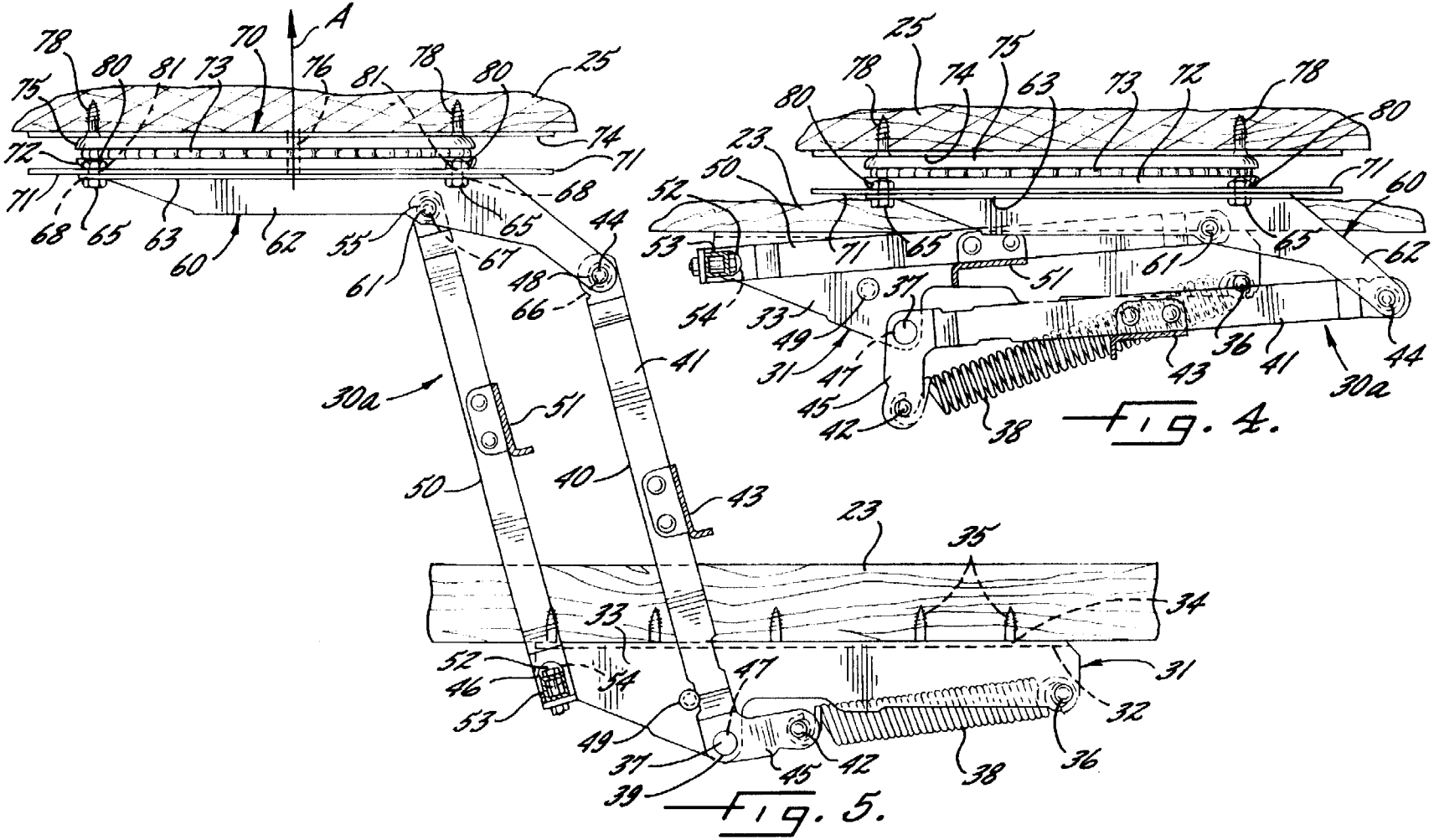
FIG. 4 is a side elevation view of a mechanism in the closed position.
FIG. 5 is a side elevation view of a mechanism in the open position.

In operation, the table 20 begins in the closed position of FIG. 4. In the closed position, the table surface 25 rests atop the mechanism support plate 23, the skirt 22, and the table surface mounting plates 60 of the four bar linkages 30*a*, 30*b*. For each of the linkages 30*a*, 30*b*, the spring extension arm of the rear pivot link 40 extends downwardly from aperture 47, and the body link 41 of the rear pivot link 40 extends rearwardly and slightly upwardly from aperture 37 to aperture 48. In this position the spring 38 is extended; the tension in the spring 38 biases the mechanism to move toward the open position. The front pivot link 50 extends rearwardly and slightly upwardly from aperture 54 to aperture 55; the front pivot link 50 is substantially parallel to the body link 41 of the rear pivot link 40. In this collapsed position, the linkages 30*a*, 30*b* nest within the rear slots 26*a*, 26*b*, the forward slots 27*a*, 27*b*, and the lateral portions of the square aperture 29 of the cavity 24.

A particular advantage of this invention is the compact configuration of the four bar linkages 30*a*, 30*b* in the closed position. Generally, the coffee table 20 will be in the closed position the large majority of the time, and will be moved to the open position only to perform certain functions, such as providing a food tray, reading desk, or card table. Because the coffee table 20 is predominantly in the closed position, the appearance of the table in the closed position will likely be important to the owner. It is generally much preferred by the owner that the linkages of the table be hidden from view in the closed position. However, it is also preferred that the pivots 37, 44, 52, and 61 of the mechanism 30 be positioned so that in the closed position, all pivots are not substantially aligned. If aligned, and thus in an "on-center" condition, the table surface 25 can become locked in the closed position and thus can be quite difficult to raise. The linkages 30*a*, 30*b* of the present invention collapse in the closed position so that the pivot pin 37 resides only about 2.5 inches from the visible surface 80 of the table surface 25, and the spring pin 42 resides only about 3 inches from the visible surface 80. Consequently, the entire mechanism 30*a*, 30*b* is hidden from view in the closed position by the skirt 22, which hangs approximately 3.5 inches from the underside of the table surface 25. Preferably, the vertical distance between spring pin 42 and the visible table surface 80 is no more than 4 inches; when so configured this invention can be used effectively with most table styles without compromising the appearance of the table. This was not true for many prior art dual height tables, which relied on devices for moving the table surface which restricted their use to certain table styles. The compact configuration is particularly attractive when structures such as the swivelling unit 70 are attached between the linkage 30 and the table 25.

In addition, the mechanisms 30*a* an 30*b* are sufficiently compact that they are able to fit within the periphery of the base 21. Preferably, in the closed position, the horizontal distance between the pivot pin 52 and the pivot pin 44 is between about 14 and 18 inches. As used herein, horizontal distance means the forward-to-rearward distance between of these pivots measured parallel to the table surface 25. In such a configuration, the mechanism 30*a* can fit within the base of the large majority of coffee table styles.

To move the table surface 25 from the open position to the closed position, a upward force is applied to the table surface 25. As the table surface 25 rises in response to the upward force, the attached swivel unit 70 and the table surface mounting bracket 60 also rise. Ascension of the table surface mounting bracket 60 causes the front pivot link 50 to rotate about the pivot pin 52 so that the end of the front pivot link 50 interconnected with the table surface mounting bracket 60 by pivot pin 61 moves upwardly and forwardly. Simultaneously, the rear pivot link 40 rotates about the pivot pin 38 so that the end of the body link 41 interconnected with the table surface mounting bracket 60 by pivot pin 44 moves upwardly and forwardly. The table surface 25 reaches its maximum height as the body link 41 of the rear pivot link 40 and the front pivot link 50 are disposed vertically. The table surface 25 then continues slightly downwardly and forwardly. The movement of the mechanism 30 and the table surface 25 ceases as the front pivot link 50 strikes the stop pin 49.

Movement of the table surface 25 is aided by the tension present in the extended spring 38, which tends to pull the front spring pin 42 toward the rear spring pin 38, and thereby assists the extension of the rear pivot link 40. Assistance of this action can be particularly helpful to a frail operator of the table, as the table surface 25 can be quite heavy in some embodiments.

In the open position, the table surface 25 has moved upwardly and forwardly from its position above and adjacent the base 21. The table surface should be configured so that in the open position, the table surface 25 provides a convenient and comfortable support surface for occupants of the adjacent seating unit without any adjustment of the base 21 of the table relative to the floor. Preferably, in the open position, the table surface will be displaced between about 8 and 11 inches upwardly and about 12 and 16 inches forwardly relative to the base 21 from its location in the closed position.

It is noteworthy that, in this embodiment, when viewed in side elevation (as in FIGS. 4 and 5), the pivot pins 37, 44, 61 and 52 are positioned on the base mounting bracket 31 and the table surface mounting bracket 60 so that in the open position, the closed position, and all intermediate positions, line segments drawn between adjacent pivots pins (i.e., from pivot pins 37 to 44, 44 to 61, 61 to 52, and 52 to 37) form a parallelogram. This parallelogrammatic configuration permits the table surface 25 to maintain a substantially horizontal disposition throughout its movement between the open and the closed positions. As used herein, a "substantially horizontal disposition" of the table surface means that the table surface varies from the horizontal plane defined by the floor by no more than about 5 degrees. Those skilled in this art will appreciate that slight adjustment of the positions of the apertures on the table surface mounting bracket 60, the base mounting bracket 31, the front pivot link 50 and the rear pivot link 40 can produce a four bar linkage which causes the table surface to vary slightly from horizontal during operation but still maintain a substantially horizontal disposition. Thus, although a substantial parallelogrammatic configuration of a four bar linkage is illustrated herein, the invention encompasses and four-bar linkage means that allows the table surface to maintain a substantially horizontal disposition when travelling between the open and the closed positions. Those skilled in this art will also appreciate that a mechanism can be constructed that does not allow maintenance of a horizontal disposition by the table surface during movement between the closed position and the open position, but which does provide a horizontally disposed table surface in the open and closed positions, although this is generally less preferred.

The table is returned to the closed position from the open position by reversing the motion of the table surface 25. A rearward and slightly upward force on the table surface 25 causes the table surface 25, the swivel unit 70 and the table surface mounting bracket 60 to rise and move rearwardly. This action, which of course causes the pivot pin 61 and the pivot pin 44 to move also, forces the front pivot link 50 to rotate about pivot pin 52; similarly, the body link 41 of the rear pivot link 40 rotates about the pivot pin 38. The table surface 25 reaches a maximum height as the body link 41 and the front pivot link 50 are vertically disposed, then begins to descend as it continues rearwardly. The pivot links 40, 50 continue to rotate about their respective pivot 52, 38. The downward and rearward action of the table surface 25 and the pivot links 40, 50 continues until these components return to the configuration of the closed position.

It can be observed that the pivotal movement of the rear pivot link 40 causes the front spring pin 42 to be drawn away from the rear spring pin 36 and thereby place the spring 38 in tension. This tension resists the movement of the table to the closed position and thus prevents the table surface 25 from slamming onto the mounting plate 23, which could otherwise occur when the table surface 25 is moved strength to manipulate the table surface 25 easily. Those skilled in this art will appreciate that, although a spring is illustrated herein, any means for biasing the movement of the linkages **30*a*, 30*b* toward the open position, such as a hydraulic or gas cylinder assembly, is also suitable for use with this invention. Further, the biasing means need not be attached to the mounting bracket 31 and the rear pivot link 40**, but instead can be attached to any number of locations on the table mechanism an be operable.

Figure 2:
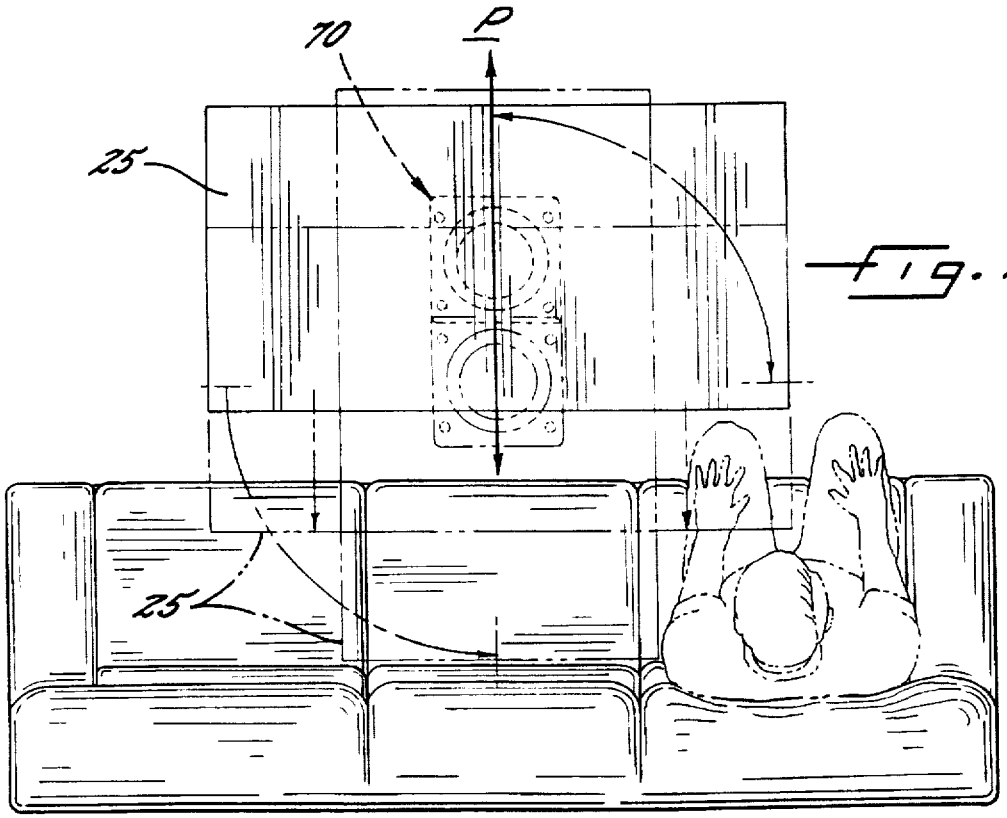
FIG. 2 shows a top view of the coffee table which illustrates the conventional and swivelled positions.
Figure 3:
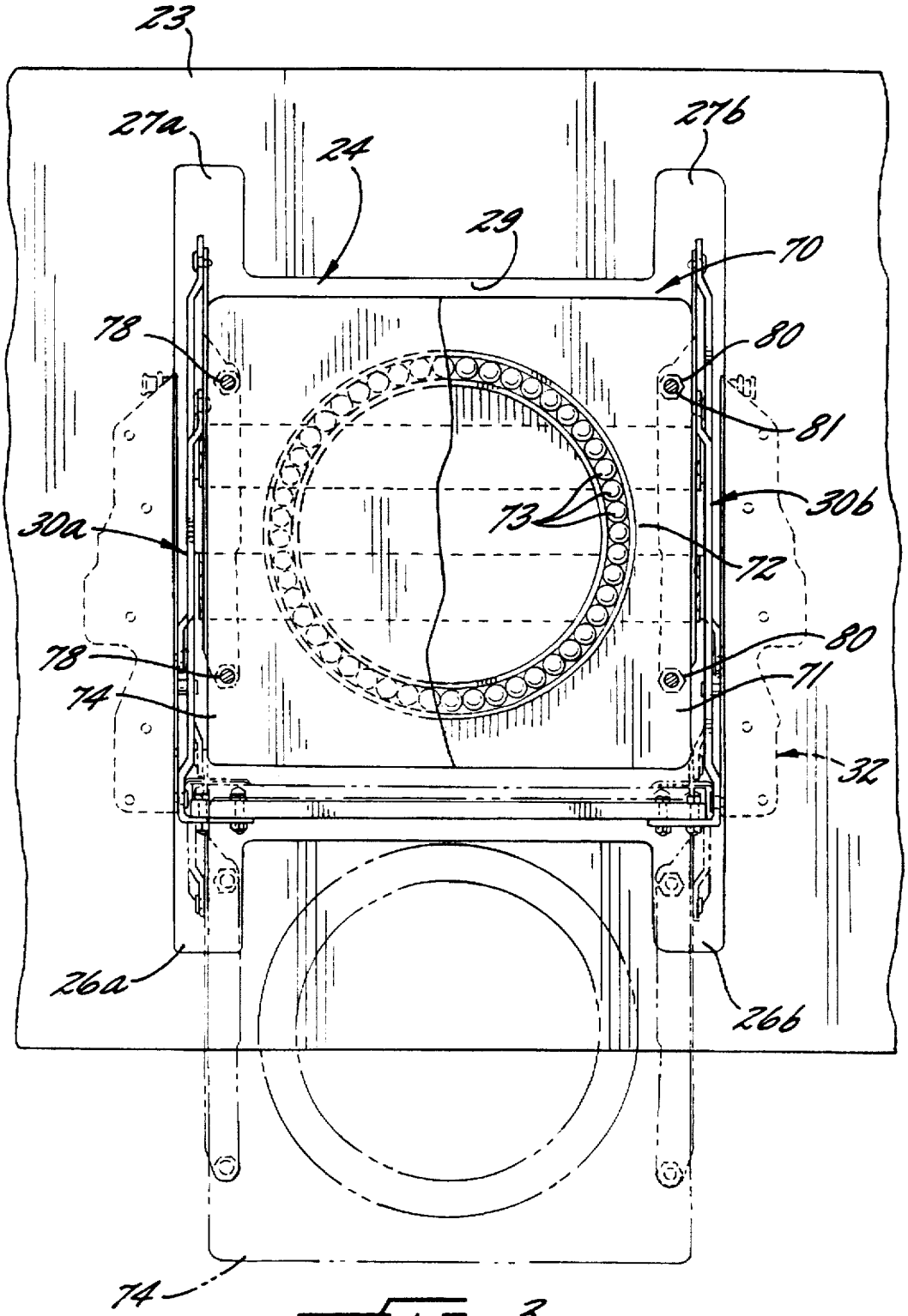
FIG. 3 is an enlarged cutaway view taken along line 3—3 of FIG. 1.

The swivel unit 70 provides means by which the table surface 25 can be rotated relative to the base 21 about axis of rotation A normal to the visible surface 80 of the table 20. Inclusion of this feature is particularly advantageous when used in conjunction with a table having a rectangular table surface (as is illustrated herein), as the table surface 25 can be rotated so that the orientation of the length dimension of the table surface 25 (i.e., from lateral edge to lateral edge) is most convenient for the occupant of the adjacent seating unit. For example, in the illustrated embodiment, FIG. 2 shows how with the table surface 25 oriented so that its length parallels the backrest of the adjacent seating unit, the table surface 25 can provide a support surface, such as a food tray, for occupants seated beside one another on the sofa. Rotation of the table surface 25 90 degrees so that its length is perpendicular to the backrest of the sofa (shown in phantom line in FIG. 2) provides a table surface that resides between occupants seated on either end of the sofa; in this configuration, the table surface 25 can serve as a card table, drink tray, and the like. Also, an occupant seated on either end of the adjacent seating unit can rotate the table surface 25 to this position (i.e., in which the length is perpendicular to the backrest of the sofa) so that he can rise from the sofa without having to lower the table surface to the closed position. Moreover, because of the base 21 being relatively narrow in the lateral direction, swivelling of the table surface 25 to the 90 degrees extended position allows the occupant to extend a footrest from the seating unit without interference from the table 20.

Those skilled in this art will appreciate that, although the ball bearing-driven swivel unit 70 is illustrated herein, any swivel means which permits the table surface 25 to rotate relative to the base in a plane parallel to visible surface 80 of the table 20 is suitable for use with this invention. Exemplary alternative swiveling means include any number of different configuration of bearings, spindles, and the like. Also, though the swivel-unit is illustrated as being attached to both table surface mounting brackets of both mechanisms 30, and thus provides an axis center of rotation for the table surface 25 that coincides with the center of the table surface 25, those skilled in this art will appreciate that the swiveling means may be attached to any portion of the table surface that provides an advantageous swivelling motion, and therefore can be attached to provide an eccentric axis of rotation. Further, the swivel means can be attached to only one mechanism, which can also provide an eccentric axis rotation if desired. Finally, the swivel unit 70 can be omitted entirely if swivelling action is not desired.

Figure 6:
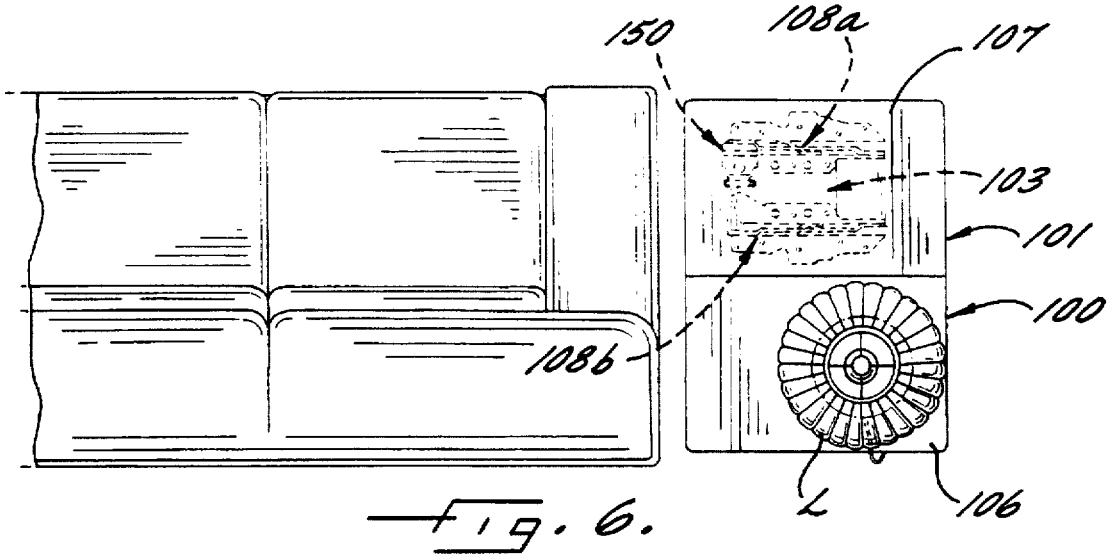
FIG. 6 is a top view of an end table having a stationary and a movable table surface in which the end table is positioned adjacent a sofa.
Figure 7:
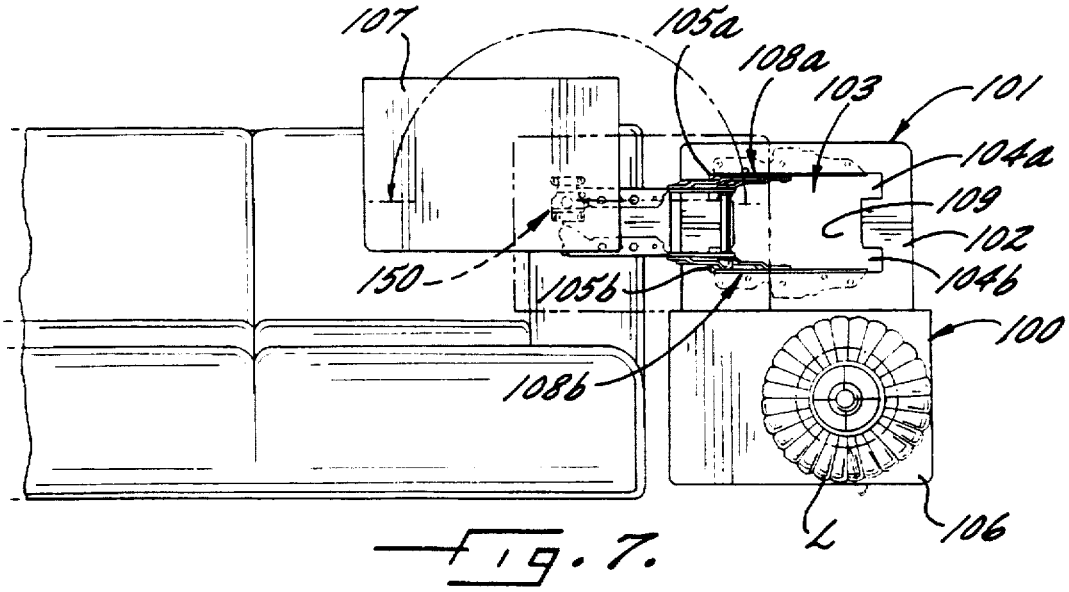
FIG. 7 is a top view of an end table in which the movable table surface is in the open position, and in which the table surface is swivelled to its most extended position.

An alternative embodiment of the invention, in the form of an end table 100, is illustrated in FIGS. 6–10. The end table 100 comprises a base 101, a fixed table surface 106, a movable table surface 107, a pair of four-bar linkages **108*a*, 108*b* that pivotally interconnect the base 101 and the movable table surface 107, and a swivel unit 150. The base 101 includes a mechanism support plate 102, which is fixed about its periphery to the base 101. The mechanism support plate 102 includes an H-shaped opening 103 which comprises a rectangular central cavity 109, two forward slots 105*a*, 105*b* at its forward corners, and two rearward slots 140*a*, 140*b* at its rearward corners (FIG. 7). The fixed table surface 106 is fixed on its underside to the top portion of the base 101. The fixed table surface 106 provides a stationary surface to support objects (such as the illustrated lamp L, a telephone, or the like) that commonly are borne by end tables of this type, although those skilled in this art will appreciate that the invention is also operable with a movable table surface 107 that comprises the entire upper table surface of the end table 100**.

The linkages **108*a*, 108*b* (FIGS. 8 and 9) comprise identical four-bar linkages and each are identically mounted on the mechanism support plate 102; the mechanisms differ in the mounting relationship to the movable table surface 107. For clarity and brevity, only mechanism 108*a* will be described in full detail with the exception of the dissimilarity in mounting; those skilled in this art will appreciate that the mechanism 108*b*** is configured and operates in the same manner except where noted.

The mechanism **108*a* is a four-bar linkage comprising a base mounting bracket 110, a rear pivot link 120, a front pivot link 130, and a table surface mounting bracket 140. This mechanism controls the action of the movable table surface 107 between the closed position, illustrated in FIG. 6, and the open position illustrated in FIGS. 7–10**.

The mounting bracket 110 includes a horizontal portion 111 and a vertical portion 112. The horizontal portion 111 is a substantially flat plate that is fixed beneath the mechanism support plate 102 by threaded fasteners 114 inserted through apertures 113 so that it resides just laterally of the lateral edge of the cavity 109. The vertical portion 112 is fixed substantially perpendicularly to the inwardmost edge of the horizontal portion 111 and extends downwardly therefrom. A rear spring pin 116 is fixed to the rearmost inboard surface of the vertical portion 112. The mounting bracket 110 also includes an aperture 119 positioned at the forwardmost portion of the vertical portion 112 for receiving a pivot pin 132, and an aperture 126 positioned rearwardly and slightly downwardly of the aperture 119 for receiving a pivot pin 132. In addition, a stop pin 118 is fixed to and extends inwardly from the inboard surface of the vertical portion 112 of the mounting bracket 110.

The rear pivot link 120 comprises a body link 121 and a spring extension arm 125. The body link 121 includes an aperture 12 for pivotal interconnection to the base mounting bracket 110 through a pivot pin 117, and further includes an aperture 128 for pivotal interconnection to the table surface mounting bracket 140 through a at pivot pin 124. The spring extension arm 125 is fixed substantially perpendicularly to the body link 111 at the aperture 127. A forward spring pin 123 is fixed to the end of the spring extension arm 125 opposite the pivot 117. The forward spring pin 123 extends laterally to receive spring 115, which is attached at its opposite end to the rear spring pin 116.

The front pivot link 130 includes an aperture 133 at one end for pivotal interconnection to the base mounting bracket 110 through pivot pin 132, and also includes an aperture 134 at its opposite end for pivotal interconnection to the table surface mounting bracket 140 at pivot 145. At its lowermost portion near the aperture 133, the front pivot link 121 is fixed to a lower cross-brace 131 that extends to a fixed attachment on the front pivot link of the mechanism **108*b* on the opposite side of the table 100**.

The table surface mounting bracket 140 comprises a horizontal portion 141 and a vertical portion 142. The vertical portion 142 is fixed perpendicularly to the outermost edge of the horizontal portion 141. The vertical portion 142 includes an aperture 147 at its rearmost portion for pivotal interconnection to the rear pivot link 120 through pivot pin 124, and further includes an aperture 148 positioned upwardly and forwardly of aperture 147 for pivotal interconnection to the front pivot link 130 through a pivot pin 145.

The shim plate 180 (FIG. 9) extends between the linkages **108*a*, 108*b* to provide stability and uniformity of motion. The shim plate 180 includes a contact surface 181 that is fixed to the underside of the horizontal portion 141 of the table surface mounting bracket 140 by threaded fasteners 144, which are inserted through apertures 184. The contact surface 181 merges at its forward edge to a sloped transition surface 182, which then merges at its forward edge into a horizontal spacing surface 183. The spacing surface 183 includes a rivet aperture 185 for receiving rivet assembly 170. A vertical shimming surface 186 originates at the forward edge of the spacing surface 183 and extends upwardly to rest against the underside of the horizontal portion 141**.

The table surface mounting bracket 140 of linkage **108*a* is secured by its horizontal portion 141 to the swivel unit 150. The swivel unit 150 comprises a swivel collar 151 and a rivet pin assembly 170. The collar 151 includes a lower surface 152 which includes aperture 157. The collar 151 further includes a forward extension tab 153 fixed to its forward portion and a rear extension tab 154 fixed to its rear portion. The forward extension tab 153 has a forward stop edge 155 that extends substantially radially from the aperture 155. Similarly, the rear extension tab 154 has a rear stop edge 156. Each of the stop edges 155, 156 is positioned from the aperture 157 to receive the stop pin 146. The lower surface 152 merges at its inward edge to a sloped surface 158, which then merges into a horizontal medial upper surface 160; similarly, the lower surface 152 merges at its inward edge to a sloped surface 159, which then merges into a horizontal lateral upper surface 160. The upper surfaces 160, 171 are separated in elevation from the lower surface 152 sufficiently to clear the stop pin 146 as the collar 152 rotates. The upper surfaces 160, 161 are fixed to the underside of the movable table surface 107 by threaded fasteners 163, which extend through apertures 162**.

The rivet assembly 170 comprises a rivet 171 having a head 172 that rests atop and adjacent the lower surface 152 of the collar 151, a shank 173 that extends through apertures 157, 149, and 185, and a flange 174 that rests beneath and adjacent the underside of the spacing surface 183. Bushings 175 and 176 are positioned to separate the flange 174 from the spacing surface 183 and the collar 152 from the horizontal portion 141, respectively.

The horizontal portion 141 of the table surface mounting bracket 140 of the linkage **108*b* is mounted to a spacer 190 of approximately the same thickness as the swivel unit 150 of mechanism 108*a*. The spacer is not attached to the movable table surface 107, but instead rests underneath the table surface. In this configuration, the spacer 190 can provide support to the movable table surface 107 in both the closed and open positions, but because the spacer 190 does not restrain movement of the movable table surface in a plane coincident with the movable table surface 107, the table surface 107 is free to rotate about the swivel unit 150**.

In operation, the end table 100 begins in the closed position of FIG. 6. In the closed position, the movable table surface 107 rests atop the upper edge of the base 101, the spacer 170, and the swivel unit 150. The remainder of the mechanisms **108*a*, 108*b* take the same general configuration as that shown in FIG. 4 for the first embodiment described. As described earlier, the mechanism preferably folds to a closed position in which the distance between the spring pin 123 and the visible table surface is no more than about 4 inches. The horizontal distance between pivot pins 132 and 128** is preferably between about 9 and 12 inches for this embodiment.

To move the movable table surface 107 from the closed position to the open position (FIG. 7), an upward force is applied to the movable table surface 107. As the movable table surface 107 rises in response to the upward force, the attached swivel unit 150 and the table surface mounting bracket 140 also rise. Ascension of the table surface mounting bracket 140 causes the front pivot link 130 to rotate about the pivot pin 132 so that the end of the front pivot link 130 interconnected with the table surface mounting bracket 140 at the pivot pin 145 moves upwardly and forwardly. Simultaneously, the rear pivot link 120 rotates about the pivot pin 117 so that the end of the body link 41 interconnected with the table surface mounting bracket 140 at the pivot pin 124 moves upwardly and forwardly. This motion is aided by the tension in the spring 115, which tends to pull the front spring pin 123 toward the rear spring pin 116. The movable table surface 107 reaches its maximum height as the body link 121 of the rear pivot link 120 and the front pivot link 130 are disposed vertically. The movable table surface 107 then continues slightly downwardly and forwardly. The movement of the linkages **108*a*, 108*b* and the movable table surface 107 ceases as the rear pivot link 120 strikes the stop pin 118**.

It should also be noted that, for an end table such as that illustrated, it is preferred that the movable table surface 107 and the mechanisms **108*a*, 108*b* travel toward and rest in the open position following a path which will not interfere with the armrests of typical seating units. Thus, preferably, the table surface 107** will be displaced between about 4 and 6 inches upwardly and about 8 and 11 inches forwardly in traveling from the closed to the open position.

To move the movable table surface 107 from the open position to the closed position, an upward force is applied to the movable table surface 107. As the movable table surface 107 rises in response to the upward force, the attached swivel unit 150 and the table surface mounting bracket 140 also rise. Ascension of the table surface mounting bracket 140 causes the front pivot link 130 to rotate about the pivot pin 132 so that the end of the front pivot link 130 interconnected with the table surface mounting bracket 140 at the pivot pin 145 moves upwardly and forwardly. Simultaneously, the rear pivot link 140 rotates about the pivot pin 117 so that the end of the body link 41 interconnected with the table surface mounting bracket 140 at the pivot pin 124 moves upwardly and forwardly. This motion is aided by the tension in the spring 115, which tends to pull the front spring pin 123 toward the rear spring pin 116. The movable table surface 107 reaches its maximum height as the body link 121 of the rear pivot link 120 and the front pivot link 130 are disposed vertically. The movable table surface 107 then continues slightly downwardly and forwardly. The movement of the linkages 108*a*, 108*b* and the movable table surface 107 ceases as the rear pivot link 120 strikes the stop pin 118.

Figures 8, 9, 10:
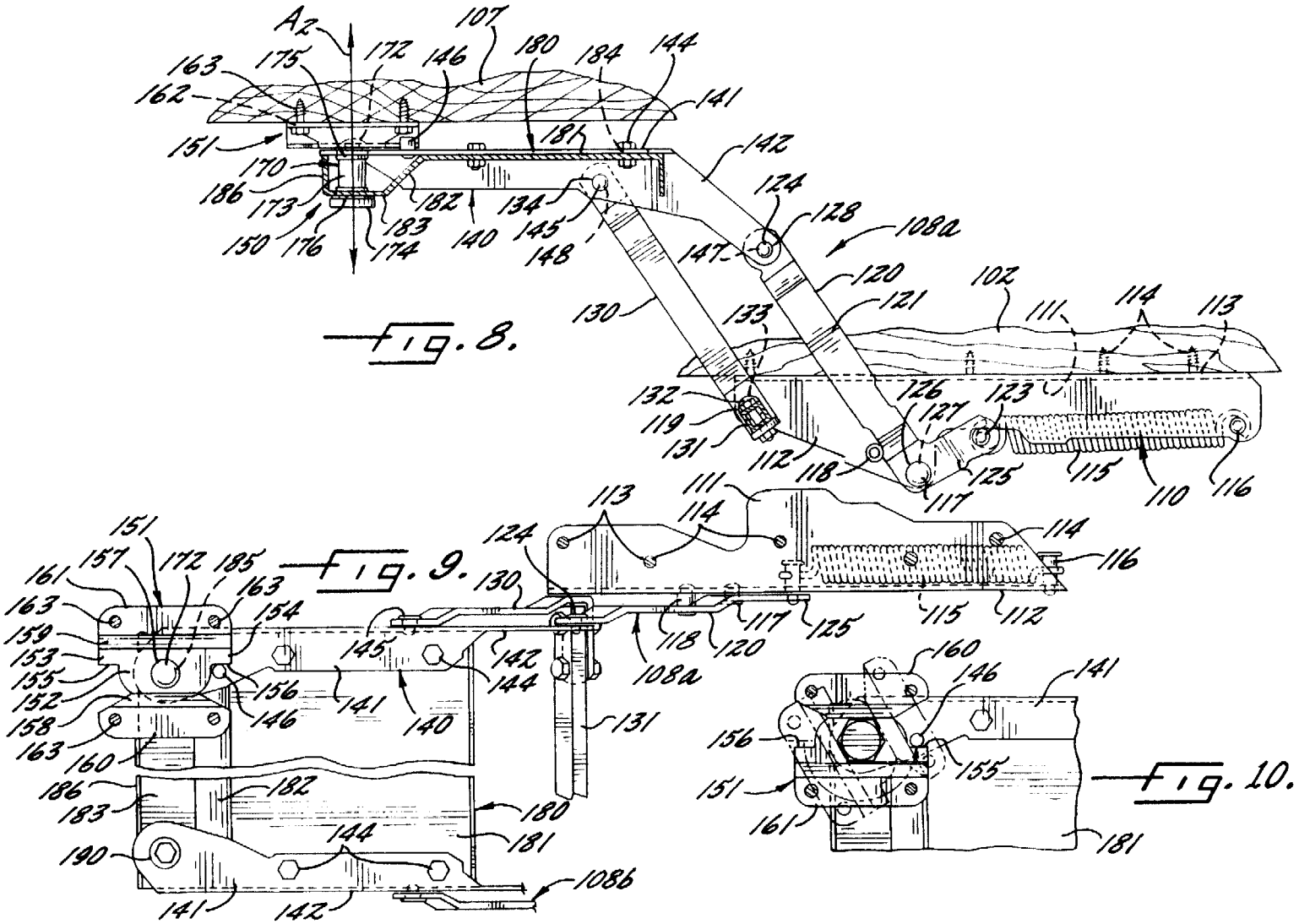
FIG. 8 is a side view of an end table mechanism in the open position.
FIG. 9 is a cutaway top view of an end table mechanism in the open position in which the table surface is in its unswivelled position.
FIG. 10 is a cutaway view of an end table mechanism in which the table surface is in its extended swivelled position.
Figure 11:
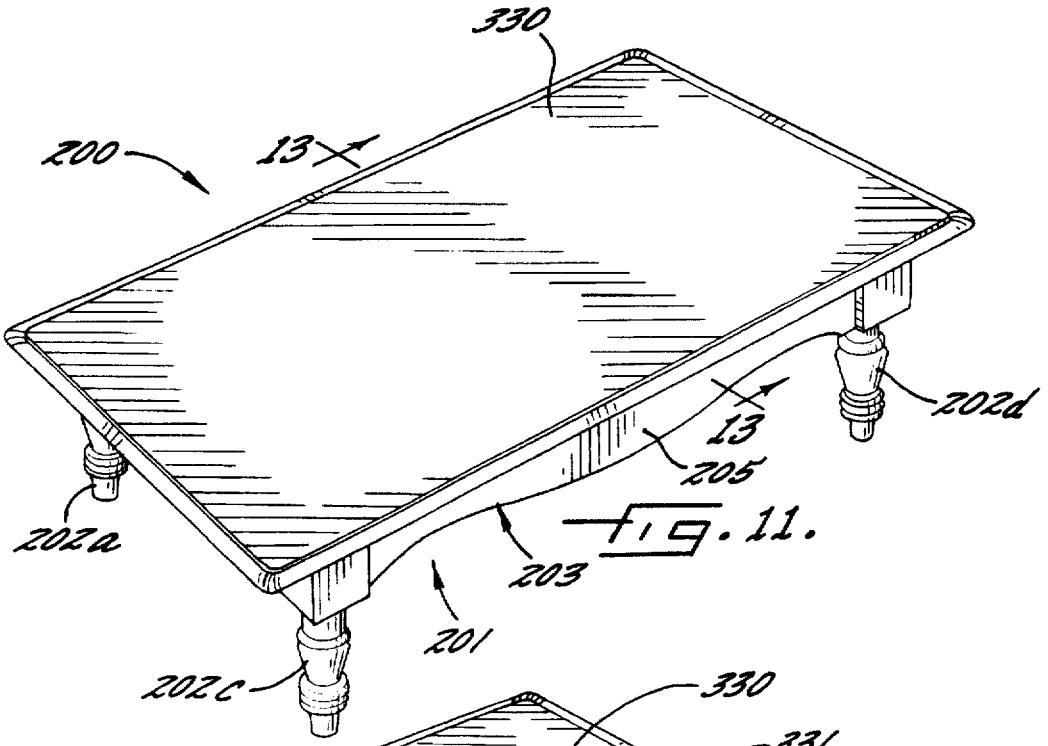
FIG. 11 is a perspective view of a movable table embodiment in its retracted position.

In addition, the presence of the swiveling unit 150 on mechanism 108*a* allows the table surface 107 to rotate about the axis of rotation $A_2$ (FIG. 10). An operator need only apply a force to the movable table surface 107 in the direction away from the fixed table surface 106 to cause the movable table surface 107 to begin to rotate. In doing so the rearwardmost edge of the movable table surface 107 moves away from the fixed table surface 106 (counterclockwise as seen in FIGS. 6 and 7). Rotation can continue for approximately 180 degrees until the rearward stop edge 155 of the collar 151 contacts the stop pin 146. The table surface can then be returned to its original position by reversing the direction of rotation.

The preferred embodiment has an eccentric axis of rotation relative to the movable table surface 107. Because the axis of rotation is forward of rather than coincident with the center of the movable table surface 107, in its fully rotated position the movable table surface is able to extend a greater distance from the base 101 toward and over a seating unit than would a table surface rotating about its center. In this position it can be envisioned that more of the table surface 107 may be available for use by an occupant of the seating unit. Preferably, the axis of rotation is shifted between about 4 and 8 inches forward of the center of the table surface 107.

Further, because the axis of rotation is positioned lateral of the center of the movable table surface 107 away from the fixed table surface 106, in the fully rotated position the movable table surface is spaced farther from the backrest of the seating unit. By the table surface 107 being so spaced, the occupant of the seating unit has more maneuvering room behind the table surface 107. Preferably, the axis of rotation is shifted laterally between about 1 and 4 inches from the center of the table surface in the direction away from the fixed table surface 106. Those skilled in this art will appreciate that although an axis of rotation that is eccentric in both the forward and lateral directions is preferred, a table having a center of rotation that is eccentric in only one of these directions or even in neither direction (i.e., the center of the movable table surface and the axis of rotation are coincident) is encompassed by the present invention.

An additional embodiment of a table movable between a retracted and an extended position is shown in FIGS. 11–15. The table, broadly designated at 200 in FIG. 11, comprises a base 201, a pair of mechanisms 220, 220*a* for moving the table between the retracted and extended positions, a swivel unit 310, and a table surface 330. As described for the embodiments illustrated in FIGS. 1–10, in the retracted position (shown in FIGS. 11, 13 and 15), the table surface 330 is generally horizontally disposed above and adjacent the base 201, and in the extended position (shown in FIGS. 12 and 14), the table surface 330 is generally horizontally disposed above the base 201 so that a major portion of the table surface 330 is positioned forward of the base 201. In this embodiment, however, the portions of the mechanisms 220, 220*a* that are visible to a lateral observer viewing the table 200 in the extended position are configured so that it appears that the table surface 330 is supported by only one link at each end rather than by a pair of links. Because so little of the material comprising the mechanisms 220, 220*a* is visible from this viewing position, the table takes on a much sleeker and thus more desirable appearance. In addition, the configuration of these links virtually eliminates any "pinch points" between the pivot links of the mechanisms 220, 220*a* that could cause pain or discomfort to an operator of the table 200 during movement between the retracted and extended positions.

It is to be understood that the definition of the terms "forward," "front," "forwardly," "rearward," "rearwardly," "lateral," "laterally" "inboard," "inward," and "inwardly" set forth hereinabove are equally applicable to this invention. Also, those skilled in this art will appreciate that tables of the present of the present invention can include a coffee table as illustrated herein, an end table of the type illustrated in FIGS. 6–10, a table concealed inside an ottoman such as that illustrated in co-assigned and co-pending U.S. patent application Ser. No. 08/084,429, and any other table for which a table surface that extends and retracts as described herein is desirable.

The rectangular base 202 (best seen in FIG. 22) comprises a quartet of legs 202*a*, 202*b*, 202*c*, and 202*d*, and a skirt 203. The skirt 203 comprises a front rail 204, a pair of lateral rails 206, 206*a*, and a rear rail 205. The front rail 204 is fixed at its lateral ends to the upper portions of forward legs 202*a*, 202*b*. The lateral rails 206, 206*a* are fixed at their forward ends to the upper portions of forward legs 202*a*, 202*b* and are also fixed at their rearward ends to the upper portions of rearward legs 202*c*, 202*d*. The rear rail 205 is fixed at its lateral ends to the upper portions of the rearward legs 202*c*, 202*d*. The front rail 204, the lateral rails 206, 206*a*, the rear rail 205, and the legs 202*a*, 202*b*, 202*c*, 202*d* are all fixed relative to one another so that their upper surfaces are essentially coplanar to provide a level surface upon which the table surface 330 can rest in the retracted position, although those skilled in this art will appreciate that these upper surfaces can vary in altitude somewhat from one another and still be suitable for use with this invention.

A pair of interior rails 208, 208*a* are fixed to extend from the rearward surface of the front rail 204 to the front surface of the rear rail 205. Each of a pair of lateral plates 210, 210*a* extends laterally from each of the interior rails 208, 208*a* to the corresponding of the lateral rails 206, 206*a*, and also extends from the front rail 204 to the rear rail 205. The interior rail 208, the portion of the front rail 204 lateral of the interior rail 208, the lateral rail 206, the portion of the rear rail 205 lateral of the interior rail 208, and the plate 210 define a lateral storage bin 207; similarly, a lateral storage bin 207*a* is defined by the interior rail 208*a*, the portion of the front rail 204 lateral of the interior rail 208*a*, the lateral rail 206*a*, the portion of the rear rail 205 lateral of the interior rail 208*a*, and the plate 210*a*. A central plate 209 extends between the central portions of the front rail 204 and the rear rail 205 and the interior rails 208, 208*a*; these rails and the central baseplate 209 define a central storage bin 212. The three storage bins 207, 207*a*, 212 are covered by the table surface 330 when the table 200 is in its retracted position, but can be exposed and thus accessed by an operator by moving the table surface 330 to the extended position. Those skilled in this art will appreciate that although three storage bins are illustrated herein, tables of the present invention may contain more or fewer storage bins as desired; these can be formed by the inclusion or omission of interior rails and additional rails extending parallel or obtusely to the lateral direction. Further, the receptacles can comprise separate removable units (such as thermoformed bins) which rest within the base 201, in which case the plates 209, 210, and **210*a*** would generally be omitted. Moreover, the storage bins can be omitted entirely if desired.

The mechanisms 220, **220*a* that control the movement of the table surface 330 between the extended and retracted positions are each fixed to the interior surfaces of the skirt 223. The mechanisms 220, 220*a* are mirror images of one another about the plane of symmetry P shown in FIG. 12; accordingly, only the mechanism 220 will be described in detail herein, with the understanding that the discussion is equally applicable to the mirror image mechanism 220*a***.

The mechanism 220 comprises a base mounting assembly 221, a front pivot link 260, a rear pivot link 280, and a table mounting bracket 300. As will be understood by those skilled in this art, these components are pivotally interconnected to form a four-bar linkage. As used herein, a four-bar linkage is a hinged chain of links and their equivalents having one rotational degree of freedom. See, e.g., Paul, *Kinematics and Dynamics of Planar Machinery* (Prentice-Hall, Inc. 1979). This term is intended to encompass mechanical configurations having multiple interconnected four-bar linkages.

The base mounting assembly 221 (FIGS. 13 and 14) comprises a front member 222 and a rear member 250. The front member 222 includes a horizontal plate 235, a vertical plate 226, and a front plate 223. The upright front plate 223 confronts and is fixed to the rearward surface of the front rail 204 by threaded fasteners 224, which are inserted through apertures 225. The vertical plate 226 is fixed substantially perpendicularly to the lateral edge of the front plate 223 and extends rearwardly therefrom. An elongated stairstep-shaped pocket 229 protrudes into the central portion of the vertical plate 226 from the lower edge thereof. The vertical plate 226 is pivotally interconnected to the rear pivot link 280 at a pivot 231 located just forwardly of the pocket 229. Also, the vertical plate 226 is pivotally interconnected to the front pivot link 260 at a pivot 231 located forwardly and upwardly of the pivot 230. A stop pin 227 is fixed to and projects inwardly from the inboard surface of the vertical plate 226 forward of and slightly above the pivot 230. An alignment pin 228 projects from the lower rear corner of the lateral surface of the vertical plate 226. A spring pin 232 projects laterally from its fixed attachment to the lateral surface of the front member 222 just above the pocket 229. The horizontal plate 235 (FIG. 15) is fixed substantially perpendicularly to the top edge of the vertical plate 226 and extends laterally therefrom; an aperture 236 is located in the central rear portion of the horizontal plate 235.

The rear member 250 of the base mounting assembly 221 comprises a rear plate 251, a vertical plate 254, and a horizontal plate 257. The upright rear plate 251 (FIGS. 13 and 14) confronts and is fixed to the forward surface of the rear rail 205 of the table skirt 203 by threaded fasteners 252, which are inserted through apertures 253. The vertical plate 254 is fixed substantially perpendicularly to the lateral edge of the rear plate 251. The vertical plate 254 contacts the lateral surface of the vertical plate 226 of the front member 222 and extends in parallel relation thereto. A rear portion of the lower edge of the vertical plate 254 rests upon the upper surface of the alignment pin 228. A finger 255 extends forwardly from the lower rear portion of the vertical plate 254 and beneath the front portion thereof, thereby forming a slot 256 between the front portion and the upper edge of the finger 255 that captures the spring pin 232. The horizontal plate 257 (FIG. 15) is fixed substantially perpendicularly to the top edge of the vertical plate 254 and extends laterally therefrom; the horizontal plate 257 resides beneath and in parallel contacting relation with the underside of the horizontal plate 235 of the front member 222. A slot 258 originates in the forward portion of the horizontal plate 257 and extends rearwardly therefrom. The slot 258 is positioned directly beneath the aperture 236 located in the horizontal plate 235 of the front member 222; in this position, the slot 258 can receive a rivet 237 that is seated against the upper surface of the horizontal plate 235, extends through the aperture 236 and the slot 258, and is captured on the lower surface of the horizontal plate 257.

Figure 15:
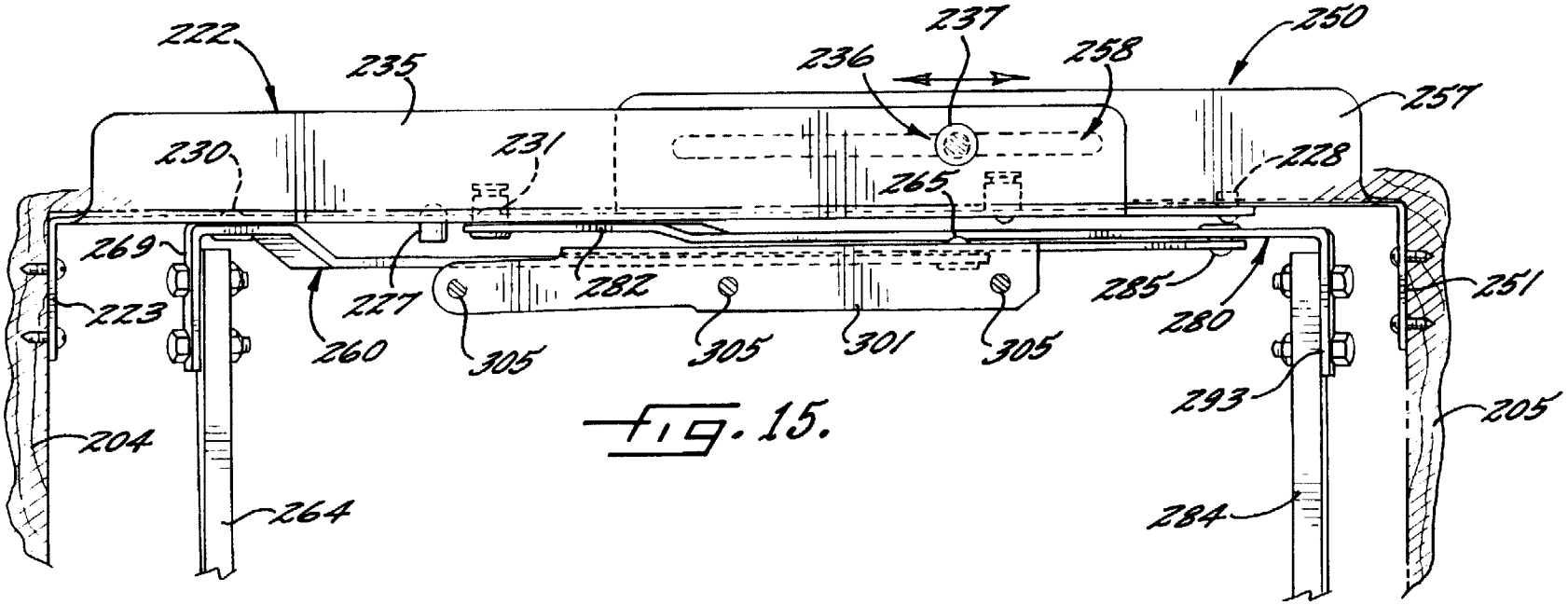
FIG. 15 is a plan view of one of the mechanisms controlling the movement of the table surface shown in the retracted position.

Thus configured, the front and rear members 222, 250 are able to slide forwardly and rearwardly relative to one another prior to the installation of the base mounting assembly 221 in the base 201 (FIG. 15). The front and rear members 222, 250 are constrained by the parallel and contacting relationship of the vertical plates 226, 254, the parallel and contacting relationship of the horizontal plates 235, 257, contact between the lower edge of the vertical plate 254 and the alignment pin 228, and the presence of the rivet 237 within the slot 258; thus these members are free to slide forwardly and rearwardly relative to one another as the rivet 257 moves within the confines of the slot 258. The sliding motion of the members 222, 250 enables the assembly 221 to be utilized in tables of varying widths; because both pivots 230, 230, the spring pin 232, and the stop pin 227 are fixed to the front member 222, their positional relationship is unaffected by sliding motion of the rear member 250 relative to the front member 222, and thus adjustment of the length of the base mounting assembly 221 to fit a table of a particular width does not affect the functioning of the remainder of the mechanism 220. Those skilled in this art will appreciate that, although the illustrated configuration is preferred, the mounting assembly 221 can include any means for adjusting its length (i.e., its size in the forward and rearward direction) and be suitable for use with the present invention.

Figures 13, 14:
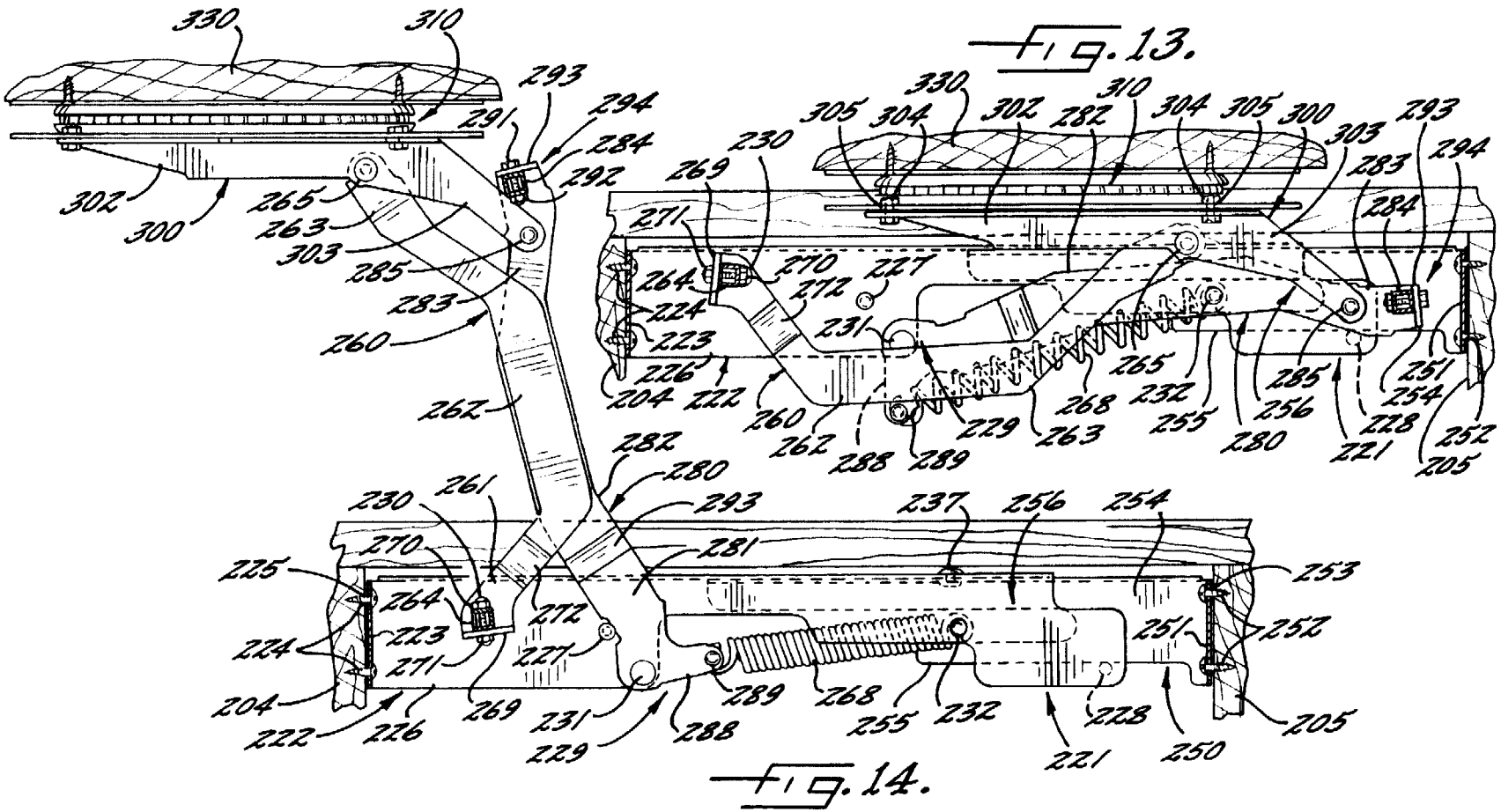
FIG. 13 is a cross-sectional view taken along line 13—13 of FIG. 11 showing the movable table mechanism in its retracted position.
FIG. 14 is a cross-sectional view taken along line 14—14 of FIG. 12 showing the movable table mechanism in its extended position.

The front pivot link 260 has a tripartite structure comprising a lower arm 262, a central portion 262, and an upper arm 263 (as a point of reference, the "upper" and "lower" arms are so designated based on their orientation in the extended position shown in FIG. 14). The lower arm 261 is pivotally interconnected at its lower end to the front member 222 at the pivot 228 and is fixed at its upper end to the lower end of the central arm 262. The lower arm 261 includes in its center an inboard offset 272, which causes those portions of the front pivot link 260 located above the offset 272 to be positioned and travel in a vertical plane inboard of the plane in which the lower portion of the lower arm 261 is positioned and travels. Fixed to and extending inwardly from and substantially perpendicular to the lower end of the lower arm 261 is an inboard extension tab 269. A stabilizer tube 264 of square cross-section is fixed at one end to the upper surface of the inboard extension tab 269 by a bolt 270 inserted through aperture 272 and received in a nut 271. This stabilizer tube 264 extends from this fixed attachment to a mirror image attachment to the front pivot link of the mechanism **220*a*. The central arm 262 is fixed at its lower end to the upper end of the lower arm 261 to form an angle therebetween of approximately 135 degrees. At its upper end the central arm 262 is fixed to the lower end of the upper arm 263 to form an angle therebetween approximately 135 degrees. At its upper end the upper arm 263 is pivotally interconnected with the table mounting bracket 300 at a pivot 265. The configuration of the front pivot link 260 is such that, when the table surface 330 is in the extended position, the central arm 262 is rearwardly offset from and substantially parallel to a line extending from the pivot 230 to the pivot 265; for coffee tables of the type illustrated herein, the central arm 262** is preferably offset rearwardly from this line between about 1 and 4 inches.

The rear pivot link 280 is also a tripartite structure comprising a lower arm 281, a central arm 282, and an upper arm 283. The lower arm 281 is pivotally interconnected at its lower end with the front member 222 of the base mounting assembly 221. The lower arm 281 includes in its upper portion an inward offset 293, which causes those portions of the rear pivot link 280 located upwardly from the offset 293 to be positioned and travel in a more inward vertical plane than that of the lower portion of the lower arm 281. In the illustrated embodiment, the inboard offsets 272, 293 are configured and sized so that the central portion 262 and the upper arm 263 of the front pivot link 260 are positioned and travel in a vertical plane that is inward of the plane in which the central portion 282 and the upper arm 283 travel. A spring extension arm 288 is fixed to and projects from the lower end of the lower arm 281. The central arm 282 is fixed at its lower end to the upper end of the lower arm 281 to form an angle therebetween of approximately 150 degrees. The central arm 282 is slightly wider (i.e., greater in distance from its front edge to its rear edge) than the central arm 262 of the front pivot link 260. The upper arm 283 is fixed at its lower end to the upper end of the central arm 282 to form an angle of approximately 160 degrees. The upper arm 283 is pivotally interconnected to the table mounting bracket 300 at a pivot 285, which is located in the central portion of the upper arm 283. A stabilizer tube extension tab 293 projects inwardly from the upper end of the upper arm 283. A stabilizer tube 284 similar in cross-section to the tube 264 is fixed to the tab 293 with a bolt 291 inserted through an aperture 294 and secured with a nut 292. The rear pivot link 280 is configured so that in the extended position, the central portion 282 is offset forwardly from and substantially parallels a line extending between the pivots 231 and 285. In coffee tables such as that illustrated herein, it is preferred that the central portion be offset from this line between about 0.5 and 3 inches.

A spring pin 289 protrudes laterally from its fixed attachment with the rearward end of the spring extension arm 288. A helical spring 268 hooks at one end over the spring pin 289 and at its other end to the spring pin 232, thereby extending laterally from the vertical plates 226, 254 of the base mounting assembly 221. The spring 268 is sized and configured so that it is in tension when the table surface 330 is in the retracted position, thus biasing the table surface 330 toward the extended position. Those skilled in this art will appreciate that although a spring is illustrated herein and is preferred, any means for biasing the table surface 330 toward the extended position and away from the retracted position, such as a pneumatic cylinder, a leaf spring, and the like, is also suitable for use with this invention. Further, the spring 268 may be omitted entirely if a table style is such that its inclusion is superfluous.

The table mounting bracket 300 comprises a vertical plate 302 having a rear finger 303 and a horizontal plate 301 fixed substantially perpendicularly to and extending inwardly from the top edge of the vertical plate 302. The rear finger 303 extends from the rear portion of the vertical plate at an angle of approximately 30 degrees and includes the pivot 285 at its rearward end. The pivot 265 is located in the rearward portion of the vertical plate 282 upwardly and forwardly of the pivot 285. The horizontal plate 291 is fixed to the swivel unit 310 by threaded fasteners 304, which are inserted through apertures 305.

The swivel unit 310 is identical to that illustrated in FIGS. 1–5, and is attached to the table mounting bracket 300 and to the table surface 330 in the same manner as that earlier illustrated. The advantages conferred by the swivel unit 310 are as set forth hereinabove. Those skilled in this art will appreciate that any means for swiveling the table surface about an axis extending through the center of the table surface 330 and normal to the plane defined by the upper surface 331 of the table surface 330 is suitable for use with this invention. In addition, the swivel unit 310 may be omitted entirely, in which case the table surface mounting bracket 300 is fixed directly to the underside of the table surface 330.

The advantages of the present invention over previous movable tables will become more apparent upon examination of the motion of the table from the retracted to the extended position. In the retracted position of FIG. 13, the table surface 330 is generally horizontally disposed and rests atop the upper edges of the components of the skirt 203 and the upper surfaces of the legs 202, although those skilled in this art will recognize that the table surface 330 can also reside above and adjacent the base 201 in partially contacting or entirely non-contacting relation and still be suitable for use with this invention. As with the embodiments illustrated in FIGS. 1–10, when viewed from a lateral position, the pivots 230, 231, 265, 285 define a parallelogram; this configuration is preferred over a nonparallelogrammatic geometry because it permits the table surface 330 to remain substantially horizontal throughout its movement between positions. Both the front and rear pivot links 260, 280 are generally horizontally disposed; as such, the spring extension arm 288 projects downwardly. In this position, the spring 268 is in tension and thus biases the spring extension arm 288 toward the rear of the table 200; this biasing encourages the table to move toward the extended position, thereby reducing the magnitude of the force required to move the table surface 330 to the extended position and increasing the amount of force requested to return the table surface 330 to the retracted position. The stabilizer tube 264 extends across the front region of the storage bin 212, and the stabilizer tube 284 extends across the rear region of the storage bin 212. These stabilizer tubes 264, 284, or any other stabilizing means, are preferably included in tables of the present invention to laterally stabilize and unify the movement of the mechanisms 220, **220*a*. It should be noted that in the retracted position a section of the central portion 262 of the front pivot link 260 is laterally adjacent the lower arm 281 of the rear pivot link 280 so that no gap visible to a laterally positioned of server is formed between the central portion 262 and the rear pivot link 280. As used herein, components that are "laterally adjacent" are positioned so that they visually overlap when viewed by an observer positioned laterally from the table 200**; i.e., portions of the components lie on the same lateral axis.

The table surface 330 is moved from the retracted to the extended position as an operator applies an upwardly directed force, thereby causing it to rise. The ascension of the table surface 330 and the attached swivel unit 310 draws upper arms 263 and 283 of the front pivot link 260 and the rear pivot link 280 upwardly and forwardly as they rotate about pivots 230 and 231 respectively. The rotation of the rear pivot link 280 draws the spring extension arm 288 upwardly and rearwardly; consequently, the spring 268 attached to the spring extension arm 288 decreases in length and thus reduces the magnitude of biasing the table surface 330 receives toward the extended position. The table surface 330 continues to move upwardly and forwardly until it reaches an apex in which the pivot 265 is directly above the pivot 231. From the apex, the table surface 330 moves forwardly and slightly downwardly until the forward edge of the rear pivot link lower arm 281 contacts the rear surface of the stop pin 227. At this point motion ceases; the table surface 330 is above the base 201, and the major portion of the table surface 330 resides forwardly of the base 201. For coffee tables of the present invention, the table surface will preferably be displaced between about 8 and 11 inches upwardly and about 12 and 16 inches forwardly relative to the base 201 from its location in the retracted position. For end tables of the present invention, the table surface will preferably be displaced between about 4 and 6 inches upwardly and about 8 and 11 inches forwardly in traveling from the retracted to the extended position.

FIG. 14, which shows the table 200 in the extended position, illustrates several important features of the present invention. In this position, the central arm 262 of the front pivot link 260 and the central arm 282 of the rear pivot link 280 are positioned so that they are substantially laterally aligned; i.e., the central arms 262, 282 are laterally adjacent and substantially parallel to one another. Because the central portion 282 of the rear pivot link 280 is slightly wider than the central portion 262 of the front pivot link 260, the front edge 286 of the central arm 282 of the rear pivot link 280 is forward of the front edge 266 of the central arm 262 of the front pivot link 260, and the rear edge 287 of the central arm 282 of the rear pivot link 280 is slightly rearward of the rear edge 267 of the central arm 262 of the front pivot link 260. When a table having a mechanism of this configuration is viewed by a laterally positioned observer, the central arm 262 is obscured from the view of a lateral observer, and thus the table surface 330 appears to be cantilevered from a single link. Such an appearance is often preferred by consumers over earlier extendable table embodiments in which the front pivot link is positioned forwardly of the rear pivot link so that the gap formed therebetween is visible to a lateral observer. Those skilled in this art will appreciate that, although in the illustrated embodiment the rear pivot link 280 is the lateralmost of the pivot links 260, 280, in other embodiments having different pivot locations, link configurations, or mechanism configurations, the front pivot link may be the lateralmost of the pivot links, and thus would be viewed by a lateral observer; if so, its central portion should be wider than that of the rear pivot link.

Those skilled in this art will recognize that there are a number of configurations for the front and rear pivot links in which the central arms are substantially laterally aligned. For example, the front pivot link 260 can be substantially straight, in which case the central portion 282 of the rear pivot link 280 should be forwardly offset from a line extending between the pivots 231 and 285 a sufficient distance that it laterally aligns with the central portion 262 of the straight front pivot link 260. Similarly, the rear pivot link 280 can be substantially straight, in which case the central portion 262 of the rear pivot link 260 should be rearwardly offset from a line extending between the pivots 230 and 265 a sufficient distance that it laterally aligns with the central portion 282 of the straight front pivot link 280. Further, the central portions 262, 282 can each be offset (rearwardly and forwardly, respectively) from the lines defined by the pivots 230 and 265 and 231 and 285 as long as they substantially laterally align in the extended position.

Another aesthetic advantage of the present invention over earlier embodiments lies in the positioning of the stabilizer tubes 264, 284 in the extended position. In this position, the lower stabilizer tube 264, which bridges its attachment points located near the pivot 230 on each of the pair of mechanisms 220, **220*a*, resides beneath the upper edge of the front rail 204 of the skirt 203; as a result, the stabilizer tube 264 is hidden from the view of a laterally or forwardly positioned observer. The upper stabilizer tube 284, which bridges its attachment points located at the uppermost end of the upper arm 283 of the rear pivot link 280 of each of the pair of mechanisms 220, 220*a*, resides just beneath the table surface 330**, and thus is also obscured from view for any observer positioned above the table surface (which certainly is the large majority of observers). As a result, consumers that favor an extendable table with a minimum of visually exposed mechanism much prefer the stabilizer configuration of the present invention to those of earlier extendable table configurations.

An additional benefit offered by the present invention can be understood by comparison of the present invention as illustrated in FIGS. 13 and 14 with those of earlier versions of such a table. Table mechanisms that include straight front and rear pivot links have inherent to their motion "pinch-points," which occur when, during operation of the mechanism, a portion of a link moves to a position in which it could pinch the finger, foot, or other appendage of an operator against another link or structure of the table. In tables having straight front and rear pivot links, a pinch point is created between the front and rear pivot links as the table is moved from the extended to the retracted position; the rear edge of the front pivot link moves adjacent the front edge of the rear pivot link, so an operator improperly gripping the table or otherwise inadvertently placing a finger between these links during retraction of the table could receive a sharp and painful pinch.

In contrast, as has been described hereinabove, the central portions 262, 282 of the front and rear pivot links 260, 280 are substantially aligned in the extended position as shown in FIG. 14. As the table surface moves from the extended to the retracted positions, the pivot links 260, 280 rotate about pivots 230, 231 so that the rear edge 287 of the rear pivot link central portion 282 leads the rear edge 267 of the front pivot link central portion 262. The rear edge 287 of the rear pivot link central portion continues to lead the rear edge 267 of the front pivot link central portion 262 until the table surface 330 reaches an intermediate position in which the pivots 230, 231, 265, 285 define the corners of a rectangle. From this position, the rear edge 267 of front pivot link central portion 262 leads the rear edge 287 of the rear pivot link central portion 282 as they rotate to the retracted position. Also, as the table surface 330 moves from the extended to the retracted position, the configurations of the front pivot link 260 and the rear pivot link 280 are such that the front pivot link central portion 262 is drawn toward the lower arm 281 of the rear pivot link 280. However, during the movement of the table surface 330, some portion of the central portion 262 remains laterally adjacent the rear pivot link 280 with the result that no gap is formed therebetween. Consequently, no pinch-point is created between the front and rear pivot links 260, 280.

The foregoing embodiments are illustrative of the present invention, and are not to be construed as limiting thereof. The invention is defined by the following claims, with equivalents of the claims to be included therein.

That which is claimed is:

1. A table comprising:

a base;

a table surface; and a mechanism for controlling the movement of said table surface relative to said base between a retracted position, in which said table surface is generally horizontally disposed above and adjacent said base, and an extended position, in which said table surface is generally horizontally disposed above said base and a major portion of said table surface resides forwardly of said base, said mechanism comprising:

(a) mounting means attached to said base;

(b) a front pivot link comprising lower, central, and upper portions, the central portion having front and rear edges, said lower portion being pivotally interconnected with said base mounting means at a first pivot;

(c) a rear pivot link comprising lower, central, and upper portions, the central portion having front and rear edges, said lower portion being pivotally interconnected with said base mounting means at a second pivot; and (d) means for mounting said mechanism to said table surface pivotally interconnected with said front pivot link upper portion at a third pivot and with said rear pivot link upper portion at a fourth pivot;

said front and rear pivot links being configured so that a first of said pivot link central portions is lateral of a second of said pivot link central portions and so that in the extended position, said rear edge of said first pivot link central portion is rearward of said rear edge of said second pivot link central portion and said front edge of said first pivot link central portion is forward of said front edge of said second pivot link central portion.

2. A table according to claim 1, wherein said front pivot link is configured so that said front pivot link central portion is inward of said rear pivot link central portion.

3. A table according to claim 2, wherein in the extended position, said rear edge of said front pivot link central portion is positioned between about 0.1 and 0.5 inches from said rear edge of said rear pivot link central portion, and said front edge of said rear pivot link is positioned between about 0.1 and 0.5 inches from said front edge of said front pivot link.

4. A table according to claim 1, wherein said front pivot link central portion is rearwardly offset from a line extending between said first pivot and said third pivot.

5. A table according to claim 4, wherein said rear pivot link central portion is forwardly offset from a line extending between said second pivot and said fourth pivot.

6. A table according to claim 1, wherein said rear pivot link central portion is forwardly offset from a line extending between said second pivot and said fourth pivot.

7. A table according to claim 1, wherein said first pivot is positioned upwardly and forwardly of said second pivot, and said third pivot is positioned upwardly and forwardly of said fourth pivot.

8. A table according to claim 1, wherein as said table surface moves between the retracted and extended positions, a portion of said central portion of said front pivot link remains laterally adjacent said rear pivot link so that no gap is created therebetween.

9. A table according to claim 1, wherein said table comprises a pair of mechanisms.

10. A table according to claim 9, wherein said pair of mechanisms further comprises stabilizing means fixed to said upper arm of said rear pivot link of one of said pair of mechanisms and extending to fixedly attach to said upper arm of said rear pivot link of the other of said pair of mechanisms.

11. A table according to claim 10, wherein said stabilizing means is fixed to each of said upper arms of said rear pivot links above said fourth pivot.

12. A table according to claim 9, wherein said pair of mechanisms further comprises stabilizing means fixed to said lower arm of said front pivot link of one of said pair of mechanisms and extending to fixedly attach to said lower arm of said front pivot link of the other of said pair of mechanisms.

13. A table according to claim 12, wherein said pair of mechanisms further comprises stabilizing means fixed to said upper arm of said rear pivot link of one of said pair of mechanisms and extending to fixedly attach to said upper arm of said rear pivot link of the other of said pair of mechanisms.

14. A table according to claim 12, wherein said base has upper edges that define an upper base plane, and wherein said stabilizing means is fixed to each of said lower arms of said front pivot links the upper base plane.

15. A table according to claim 1, wherein said table base further comprises at least one storage receptacle positioned beneath said table surface when said table surface is in the retracted position, said receptacle being exposed to receive articles for storage when said table surface is moved to the extended position.

16. A table comprising:

a base;

a table surface;

a mechanism controlling the movement between a retracted position, in which said table surface is generally horizontally disposed above said base, and an extended position, in which said table surface is generally horizontally disposed above and adjacent said base and a major portion of said table surface resides forwardly of said base, said mechanism comprising:

(a) mounting means attached to said base;

(b) a front pivot link comprising lower, central, and upper portions, the central portion having front and rear edges, said lower portion being pivotally interconnected with said base mounting means at a first pivot;

(c) a rear pivot link comprising lower, central, and upper portions, the central portion having front and rear edges, said lower portion being pivotally interconnected with said base mounting means at a second pivot; and (d) means for mounting said mechanism to said table surface pivotally interconnected with said front pivot link upper portion at a third pivot and with said rear pivot link upper portion at a fourth pivot;

said front and rear pivot links being configured so that a first of said central portions of said pivot links is lateral of a second of said pivot link central portions and so that said rear edge of said first pivot link central portion is rearward of said front edge of said second pivot link central portion and said front edge of said first of said pivot link central portion is forward of said front edge of said second said pivot link central portion, and wherein said central portion of said front pivot link is rearwardly offset from a line between said first and third pivots, and wherein said central portion of said rear pivot link is forwardly offset from a line extending between said second and fourth pivots.

17. A table according to claim 16, wherein said front pivot link is configured so that said front pivot link central portion is inward of said rear pivot link central portion.

18. A table according to claim 16, wherein in the extended position said rear edge of said front pivot link central portion is positioned between about 0.1 and 0.5 inches from said rear edge of said rear pivot link central portion, and said front edge of said rear pivot link is positioned between about 0.1 and 0.5 inches from said front edge of said front pivot link.

19. A table according to claim 16, wherein said first pivot is positioned upwardly and forwardly of said second pivot, and said third pivot is positioned upwardly and forwardly of said fourth pivot.

20. A table according to claim 16, wherein as said table surface moves between the retracted and extended positions, a portion of said front pivot link remains laterally adjacent said rear pivot link so that no gap is created therebetween.

21. A table according to claim 16, wherein said table comprises a pair of mechanisms.

22. A table according to claim 21, wherein said pair of mechanisms further comprises stabilizing means fixed to said lower arm of said front pivot link of one of said pair of mechanisms and extending to fixedly attach to said lower arm of said front pivot link of the other of said pair of mechanisms.

23. A table according to claim 22, wherein said pair of mechanisms further comprises stabilizing means fixed to said upper arm of said rear pivot link of one of said pair of mechanisms and extending to fixedly attach to said upper arm of said rear pivot link of the other of said pair of mechanisms.

24. A table according to claim 23, wherein said stabilizing means is fixed to each of said upper arms of said rear pivot links above said fourth pivot.

25. A table according to claim 21, wherein said pair of mechanisms further comprises stabilizing means fixed to said upper arm of said rear pivot link of one of said pair of mechanisms and extending to fixedly attach to said upper arm of said rear pivot link of the other of said pair of mechanisms.

26. A table according to claim 25, wherein said base has upper edges that define an upper base plane, and wherein said stabilizing means is fixed to each of said lower arms of said front pivot links so that said stabilizing means remains below the upper base plane.

27. A table according to claim 16, wherein said table base further comprises at least one storage receptacle positioned beneath said table surface when said table surface is in the retracted position, said receptacle being exposed to receive articles for storage when said table surface is moved to the extended position.

28. A mechanism suitable for use with a table having a base and an extendable table surface movable between a retracted position, in which the table surface is generally horizontally disposed above the base, and an extended position, in which the table surface is generally horizontally disposed above the base and a major portion of the table surface resides forwardly of the base, said mechanism comprising:

mounting means adapted to be attached to the table base;

a front pivot link comprising lower, central, and upper portions, said central portion having front and rear edges, said lower portion being pivotally interconnected with said base mounting means at a first pivot;

a rear pivot link comprising lower, central, and upper portions, the central portion having front and rear edges, said lower portion being pivotally interconnected with said base mounting means at a second pivot; and table surface mounting means adapted to attach to the table surface, said table surface mounting means being pivotally interconnected with said front pivot link upper portion at a third pivot and with said rear pivot link upper portion at a fourth pivot;

said front and rear pivot links being configured so that one of said central portions of said pivot link is wider than the other of said pivot link central portions, and so that, when the table is in the extended position, said rear edge of the wider of said pivot link central portions is rearward of said front edge of the other of said pivot link central portions, and said front edge of said wider of said pivot link central portions is forward of said front edge of the other of said pivot link central portions.

29. A mechanism according to claim 28, wherein said front pivot link is configured so that said rear pivot link central portion is the wider of said pivot link central portions.

30. A mechanism according to claim 29, wherein in the extended position said rear edge of said front pivot link central portion is positioned between about 0.1 and 0.5 inches from said rear edge of said rear pivot link central portion, and said front edge of said rear pivot link is positioned between about 0.1 and 0.5 inches from said front edge of said front pivot link.

31. A mechanism according to claim 28, wherein said front pivot link central portion is rearwardly offset from a line extending between said first pivot and said third pivot.

32. A mechanism according to claim 31, wherein said rear pivot link central portion is forwardly offset from a line extending between said second pivot and said fourth pivot.

33. A mechanism according to claim 28, wherein said rear pivot link central portion is forwardly offset from a line extending between said second pivot and said fourth pivot.

34. A mechanism according to claim 28, wherein said first pivot is positioned upwardly and forwardly of said second pivot, and said third pivot is positioned upwardly and forwardly of said fourth pivot.

35. A mechanism according to claim 28, wherein as the table surface moves between the retracted and extended positions, a portion of said central portion of said front pivot link remains laterally adjacent said rear pivot link so that no gap is created therebetween.

* * * * *

UNITED STATES PATENT AND TRADEMARK OFFICE

CERTIFICATE OF CORRECTION

PATENT NO. : 5,549,052 Page 1 of 2

DATED : August 27, 1996

INVENTOR(S) : D. Stephen Hoffman

It is certified that error appears in the above-indentified patent and that said Letters Patent is hereby corrected as shown below:

Column 3, line 32, "lateral most" should be --lateralmost--.

Column 11, line 61, "171" should be --161--.

Column 11, line 62, "152" (second occurrence) should be --151--.

Column 13, line 5, "140" should be --120--.

Column 14, line 29, "202" should be --201--.

Figure 12:
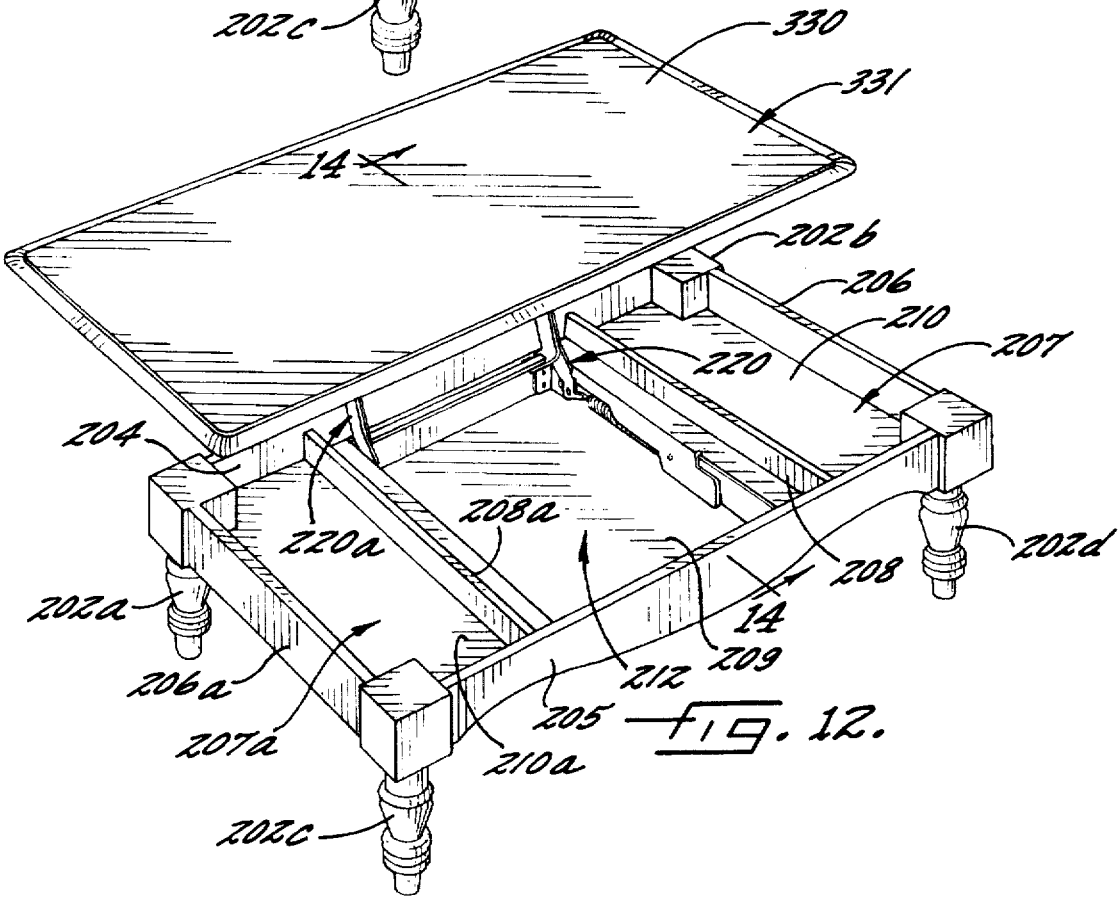
FIG. 12 is a perspective view of a movable table in its extended position.

Column 14, line 29, "FIG. 22" should be --FIG. 12--.

Column 15, line 15, "223" should be --203--.

UNITED STATES PATENT AND TRADEMARK OFFICE

CERTIFICATE OF CORRECTION

PATENT NO. : 5,549,052

DATED : August 27, 1996

INVENTOR(S) : D. Stephen Hoffman

It is certified that error appears in the above-indentified patent and that said Letters Patent is hereby corrected as shown below:

Column 16, line 33, "230" (second occurrence) should be --231--.

Column 16, line 46, "262" (first occurrence) should be --261--.

Signed and Sealed this

Tenth Day of December, 1996

*Attest:*

*Attesting Officer*

Bruce Lehman

BRUCE LEHMAN

*Commissioner of Patents and Trademarks*